US006463253B2

(12) United States Patent
Sato

(10) Patent No.: US 6,463,253 B2
(45) Date of Patent: Oct. 8, 2002

(54) CLEANING UNIT, AND IMAGE FORMING METHOD AND IMAGE FORMING APPARATUS USING SAID CLEANING UNIT

(75) Inventor: Kazuhiko Sato, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/738,437

(22) Filed: Dec. 15, 2000

(65) Prior Publication Data

US 2001/0004426 A1 Jun. 21, 2001

(30) Foreign Application Priority Data

Dec. 20, 1999 (JP) ..... 11-361049
Jul. 18, 2000 (JP) ..... 2000-217504

(51) Int. Cl.[7] ..... G03G 21/00
(52) U.S. Cl. ..... 399/350
(58) Field of Search ..... 399/343, 350, 399/351; 15/1.51, 256.5

(56) References Cited

U.S. PATENT DOCUMENTS 3,848,992 A * 11/1974 Smith ..... 399/350
4,255,044 A * 3/1981 Cormier et al. ..... 399/351 X
4,264,191 A * 4/1981 Gerbasi et al. ..... 399/350 X
4,823,161 A * 4/1989 Yamada et al. ..... 399/350
4,875,081 A * 10/1989 Goffe et al. ..... 399/343
6,021,304 A * 2/2000 Sbert et al. ..... 399/350 X
6,296,980 B1 * 10/2001 Oshiba et al.

FOREIGN PATENT DOCUMENTS

JP 57-133470 * 8/1982
JP 57-211183 * 12/1982
JP 08-83028 * 3/1996

* cited by examiner

*Primary Examiner*—Sandra Brase
(74) *Attorney, Agent, or Firm*—Frishauf, Holtz, Goodman, & Chick, P.C.

(57) ABSTRACT

A cleaning unit for removing residual toner from a photoreceptor. The cleaning unit has a cleaning blade formed of a plurality of plate materials adhered to each other, the plurality of plate materials including a first blade member and a second blade member each of which is mounted on a support member. The impact resilience of $H_1$ of the first blade member and impact resilience of $H_2$ of the second blade member satisfy the conditionof $0.1H_2<H_1$. In use, the first blade member is brought into contact with the photoreceptor and the second blade member is not brought into contact with said photoreceptor.

53 Claims, 10 Drawing Sheets

FIG. 13 ( a )
TONER HAVING NO CORNERS
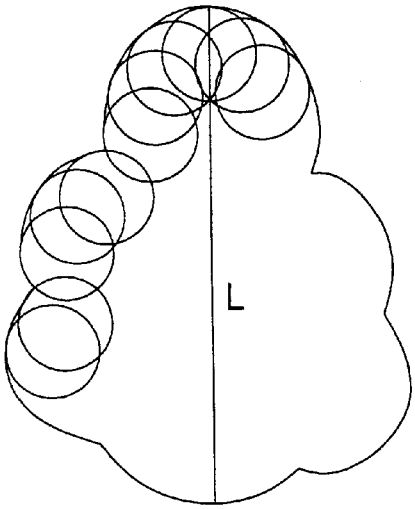
FIG. 13 ( b )
TONER HAVING CORNERS
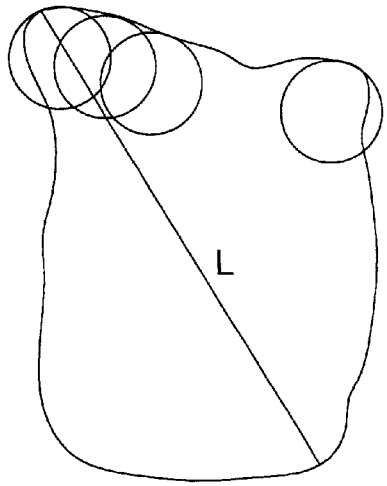
FIG. 13 ( c )
TONER HAVING CORNERS
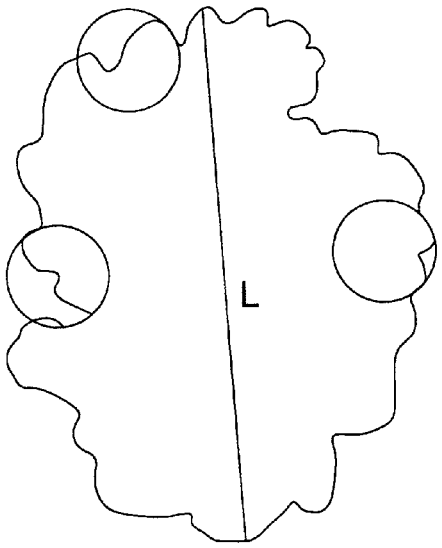

CLEANING UNIT, AND IMAGE FORMING METHOD AND IMAGE FORMING APPARATUS USING SAID CLEANING UNIT

FIELD OF THE INVENTION

The present invention relates to a cleaning unit employed in electrophotographic copiers, printers, and the like, an image forming method and an image forming apparatus employing said cleaning unit.

BACKGROUND OF THE INVENTION

In recent years, organic photoreceptors (hereinafter referred simply to as photoreceptors), comprising organic photoconductive materials, have been most widely employed as the image bearing body employed in electrophotographic image forming apparatuses. Compared to other photoreceptors, organic photoreceptors exhibit advantages in such a manner that it is easy to develop materials which correspond to various types of exposure light sources ranging from visible light to infrared rays; it is possible to select materials which result in minimum environmental pollution; their production cost is lower, and the like. However, said organic photoreceptors exhibit disadvantages in that the mechanical strength is insufficient, and during producing numerous copies and prints, the photoreceptor surface tends to be degraded or abraded.

Further, said organic photoreceptor exhibits large contact energy with the toner, which visualizes the electrostatic latent images formed on the photoreceptor. As a result, it is difficult to remove the resulting residual toner, which remains on the photoreceptor after transferring said toner image onto a transfer material in the transfer process. Thus various problems regarding the cleaning on the photoreceptor surface tend to occur.

On the other hand, due to the progress of digital technology in recent years, an image forming method utilizing a digital system has played an increasing role in the image forming method utilizing the electrophotographic system. The image forming method utilizing said digital system is basically carried out in such a manner that an image comprised of small dots, called pixels, of 400 dpi, and the like, is visualized. Demanded thus is a high image quality technique which faithfully reproduces images comprised of such small dots.

In order to realize such desired high image quality technique, one of the most important techniques is one which relates to toner production. Heretofore, for forming electrophotographic images, mainly employed has been a so-called pulverized toner which is prepared in such a manner that toner powder, which is obtained by blending and kneading binder resins with pigments and then pulverizing the resultant mixture, is subjected to classification during a classifying process. However, the toner obtained through such production processes exhibits limitation in making the particle size distribution of toner particles uniform. As a result, the particle size distribution, as well as the shape of toner particles, has not been sufficiently uniform. Thus in electrophotographic images obtained by employing such pulverized toner, it is difficult to achieve the desired high image quality.

In recent years, as a means to achieve uniform size distribution as well as uniform shape of said toner particles, proposed have been electrophotographic developer materials or image forming methods utilizing polymerized toner. Said polymerized toner is produced by uniformly dispersing monomers as the raw material in water based system and then polymerizing the resultant dispersion. As a result, it is possible to obtain a toner having a uniform size distribution as well as uniform shape.

Herein, when said polymerized toner is applied to an image forming apparatus utilizing an photoreceptor, new technical problems have surfaced. Namely, as described above, the toner particle shape of said polymerized toner is formed during the monomer polymerization process. As a result, said shape is formed to be nearly spherical. As is already well known, toner of a spherical shape, which remains on said organic photoreceptor, tends to be insufficiently removed. Specifically, the surface of the organic photoreceptor tends to be worn. When toner particles adhere to the roughened surface, caused by said wear, fine toner particles are not completely removed by cleaning, in such a range that the resultant images are not visually affected. Such toner particles, which have not been removed, stain charging members (such as charging wires and charging rollers). As a result, halftone images, and the like, are subjected to formation of image unevenness.

In order to minimize blade curl, which is generated by the image forming method employing the polymerized toner as described above, as well as to insufficient cleaning such as residual toner which has not been removed, heretofore, various proposals have been made. Of these, applied has been one proposal in which the shape of the polymerized toner is varied from a circular shape to an elliptic shape, and another in which the surface shape of the polymerization toner surface is varied into the irregular one. However, these proposals have not sufficiently overcome the stated problems.

SUMMARY OF THE INVENTION

An object of the present invention is to provide a cleaning unit which overcomes the aforementioned problems, and upon using an organic photoreceptor and a polymerized toner, maintains the desired cleaning performance for an extended period of time, results in no image problems and is capable of forming excellent electrophotographic images, and an image forming method and an image forming apparatus using said cleaning unit.

In order to overcome the aforementioned problems, the inventors of the present invention have made investigations. As a result, by adhering a second blade member onto a first blade member, it has become possible to secure excellent cleaning properties, and to maintain stable vibration of said first blade member. Thus it has become possible to overcome the aforementioned problems. Namely, it has been discovered that the object of the present invention is achieved by employing any of constitutions described below.

1. In a cleaning unit having a first blade member which removes residual toner on an organic photoreceptor after developing an electrostatic latent image formed on said organic photoreceptor, employing a developer comprising a toner and subsequently transferring a toner image, visualized through said development, onto a transfer material from said organic photoreceptor, a cleaning unit wherein said cleaning unit comprises a cleaning blade composed of a cleaning blade composed of a first blade member and a second blade member; said first blade member is brought into close contact with said second blade member on the side opposite to that which is brought into contact with said photoreceptor; and a level difference is provided between the edge of said first blade member and the edge of the said second blade member in such a manner that said level difference is positioned so that said second blade member is more apart from said organic photoreceptor.

2. In a cleaning unit having a first blade member which removes residual toner on an organic photoreceptor after developing an electrostatic latent image formed on said organic photoreceptor, employing a developer comprising a toner and subsequently transferring a toner image, visualized through said development, onto a transfer material from said organic photoreceptor, a cleaning unit wherein said cleaning unit comprises a cleaning blade composed of a cleaning blade composed of a first blade member and a second blade member; said first blade member is brought into close contact with said second blade member on the side opposite to that which is brought into contact with said photoreceptor; and the free length "a" of said blade and the free length "b" of said second blade member satisfy Formula 1.

$$0.1<b/a\leqq 0.9 \qquad \text{Formula 1}$$

3. In a cleaning unit having a first blade member which removes residual toner on an organic photoreceptor after developing an electrostatic latent image formed on said organic photoreceptor, employing a developer comprising a toner and subsequently transferring a toner image, visualized through said development, onto a transfer material from said organic photoreceptor, a cleaning unit wherein said cleaning unit comprises a cleaning blade composed of a first blade member and a second blade member; said first blade member is brought into close contact with said second blade member on the side opposite to that which is brought into contact with said photoreceptor; and thickness $t_1$ of said first blade member and thickness $t_2$ of said second blade member satisfy Formula 2.

$$1/30<t_2/t_1<2 \qquad \text{Formula 2}$$

4. In a cleaning unit having a first blade member which removes residual toner on an organic photoreceptor after developing an electrostatic latent image formed on said organic photoreceptor, employing a developer comprising a toner and subsequently transferring a toner image, visualized through said development, onto a transfer material from said organic photoreceptor, a cleaning unit wherein said cleaning unit comprises a cleaning blade composed of a first blade member and a second blade member; said first blade member is brought into close contact with said second blade member on the side opposite to that which is brought into contact with said photoreceptor; and hardness $K_1$ of said first blade member specified by JIS A "Hardness", and thickness $K_2$ of said second blade member, specified in the same, satisfy Formula 3.

$$5/7<K_2/K_1<10/7 \qquad \text{Formula 3}$$

5. In a cleaning unit having a first blade member which removes residual toner on an organic photoreceptor after developing an electrostatic latent image formed on said organic photoreceptor, employing a developer comprising a toner and subsequently transferring a toner image, visualized through said development, onto a transfer material from said organic photoreceptor, a cleaning unit wherein said cleaning unit comprises a cleaning blade composed of a first blade member and a second blade member; said first blade member is brought into close contact with said second blade member on the side opposite to that which is brought into contact with said photoreceptor; and impact resilience $H_1$ of said first blade member and impact resilience $H_2$ of said second blade member satisfy Formula 4.

$$2/7<H_2/H_1\leqq 8/7 \qquad \text{Formula 4}$$

6. In a cleaning unit having a first blade member which removes residual toner on an organic photoreceptor after developing an electrostatic latent image formed on said organic photoreceptor, employing a developer comprising a toner and subsequently transferring a toner image, visualized through said development, onto a transfer material from said organic photoreceptor, a cleaning unit wherein said cleaning unit comprises a cleaning blade composed of a first blade member and a second blade member; said first blade member is brought into close contact with said second blade member on the side opposite to the side which is brought into contact with said photoreceptor; a level difference is provided between the edge of said first blade member and the edge of the said second blade member in such a manner that said level difference is positioned so that said second blade member is more apart from said photoreceptor; and said first blade member and said second blade member satisfy Formulas 1 through 4.

7. An image forming method wherein after developing an electrostatic latent image formed on a photoreceptor, employing a developer comprising a toner and subsequently transferring a toner image, visualized through said development, onto a transfer material from said photoreceptor, any residual toner on said photoreceptor is removed employing a cleaning unit described in any one of 1. through 5. above.

8. An image forming apparatus wherein after developing an electrostatic latent image formed on a photoreceptor, employing a developer comprising a toner and subsequently transferring a toner image, visualized through said development, onto a transfer material from said photoreceptor, residual toner on said photoreceptor is removed employing said cleaning unit.

9. Preferably employed as said toner is one in which the variation coefficient of the shape coefficient of toner particles is not more than 16 percent, and the number variation coefficient of the number size distribution of said toner particles is not more than 27 percent.

10. Preferably employed as said toner is one which comprises at least 65 percent by number of toner particles in the range of the shape coefficient of 1.2 to 1.6.

11. Preferably employed as said toner is a toner which comprises at least 50 percent by number of toner particles having no corners.

12. Said photoreceptor preferably comprises an electrically conductive support having thereon a photosensitive layer, which preferably comprises, in the surface layer, polycarbonate having an average molecular weight of at least 40,000.

BRIEF DESCRIPTION OF THE DRAWINGS

FIG. 13(*a*) is an explanatory view showing a projection image of toner particle having no corners.

FIGS. 13(*b*) and 13(*c*) are explanatory views showing projection images of toner particles having corners.

DETAILED DESCRIPTION OF THE INVENTION

The inventors of the present invention have discovered that according to the aforementioned invention, it is possible to minimize blade curl and the amount of a residual toner without using excessive friction force generated between the photoreceptor and the first blade member to remove said residual toner on said photoreceptor, to effectively remove said residual toner on said photoreceptor, and to consistently obtain excellent images for an extended period of time.

Figure 1:
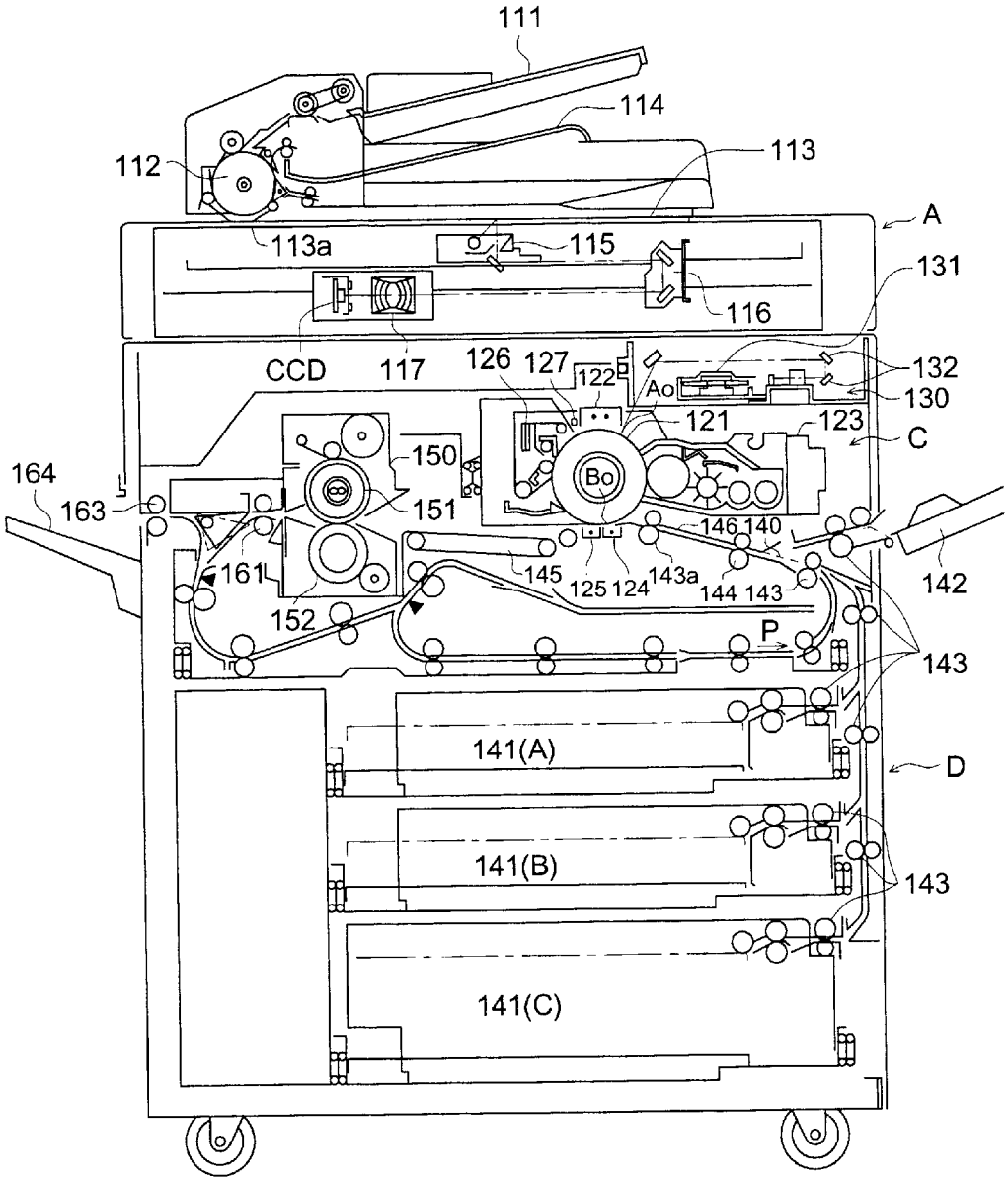
FIG. 1 is a schematic view showing the entire configuration of the image forming apparatus of the present invention.

FIG. 1 is a schematic view showing the entire structure of the image forming apparatus of the present invention.

The image forming apparatus shown in FIG. 1 is one employing a digital system, and is comprised of image reading section A, image processing section B (not shown), image forming section C, and transfer paper conveying section D as the transfer paper conveying means.

In the upper part of image reading section A, provided is an automatic document conveying means which automatically conveys the original documents. Original documents, which are placed on document platen 111, are conveyed sheet by sheet and conveyed by original document conveying roller 112, and image reading is carried out at reading position 113*a*. The original document, which has been read, is ejected onto document ejecting tray 114, utilizing document conveying roller 112.

On the other hand, the image of the original document, which is placed on platen glass 113, is read by reading operation at a speed of v of first mirror unit 115 comprised of an illuminating lamp and a first mirror which constitutes an optical scanning system and by movement at a speed of v/2 in the same direction of second mirror unit 116 comprised of a second mirror and a third mirror which are positioned in a V letter.

The read image is focused through projection lens 117 onto the receptor surface of imaging sensor CCD of a line sensor. The linear optical image, which has been focused onto the imaging sensor CCD, is successively subjected to photoelectric conversion to obtain electric signals (brightness signals), and thereafter, is subjected to A/D conversion. The resultant signals are then subjected to various processes such as density conversion, a filtering process, and the like in image processing section B, and then the resultant image data are temporarily stored in a memory.

In image forming section C, arranged as image forming units are drum-shaped image bearing photoreceptor (hereinafter referred to as a photoreceptor drum) 121, and around said photoreceptor drum, charging unit 122 as the charging means, development unit 123 as the development means, transfer unit 124 as the transfer means, separating unit 125 as the separating means, cleaning unit 126 and PCL (pre-charge lamp) 127 in said order for each cycle. Photoreceptor 121 is prepared by applying photoconductive compounds onto a drum base body. For example, organic photoconductors (OPC) are preferably employed. Said drum rotates clockwise as shown in FIG. 1.

After rotating the photoreceptor is uniformly charged employing charging unit 122, image exposure is carried out based on image signals retrieved from the memory of image processing section B, employing exposure optical system 130. In said exposure optical system 130 which is utilized as the writing means, a laser diode (not shown) is employed as the light emitting source, and primary scanning is carried out in such a manner that light passes through rotating polygonal mirror 131, an fθ lens (having no reference numeral), and a cylindrical lens (also having no reference numeral), and the light path is deflected by reflection mirror 132. As a result, image exposure is carried out at position $A_0$ with respect to photoreceptor 121, and a latent image is formed by the rotation (secondary scanning) of photoreceptor 121. In one example of the present embodiment, exposure is carried out for a text section and the latent image is formed.

The latent image on photoreceptor 121 is subjected to reversal development employing development unit 123, and a visualized toner image is formed on the surface of said photoreceptor 121. In transfer sheet conveying section D, under the image forming unit provided are sheet supply units 142(A), 141(B), and 141(C) as paper sheet storing means, in which different-sized paper sheets P are stored, and provided on the exterior, is manual paper sheet supply unit 142 by which paper sheets are manually supplied. Paper sheet P, which is selected from any of these paper sheet supply units is conveyed along conveying path 140 employing paired guide rollers 143, and the conveyance of the paper sheet P is temporarily suspended by paired register rollers 144 which correct the inclination as well as the deviation of the paper sheet P, and thereafter the conveyance resumes again. Paper sheet P is guided by conveyance path 140, paired pre-transfer rollers 143*a*, and guide plate 146 so that the toner image on photoreceptor 121 is transferred onto paper sheet P at transfer position $B_0$ employing transfer unit 124. Subsequently, charge elimination is carried out employing separation unit 125; paper sheet P is separated from the surface of the photoreceptor 121 and is conveyed to fixing unit 150, employing conveying unit 145.

Fixing unit 150 comprises fixing roller 151 as well as pressure roller 152. By passing paper sheet P between fixing roller 151 and pressure roller 152, heat as well as pressure is applied to melt-fix the toner. Paper sheet P, which has been subjected to fixing of its toner image, is ejected onto paper sheet ejecting tray 164.

Figure 2:
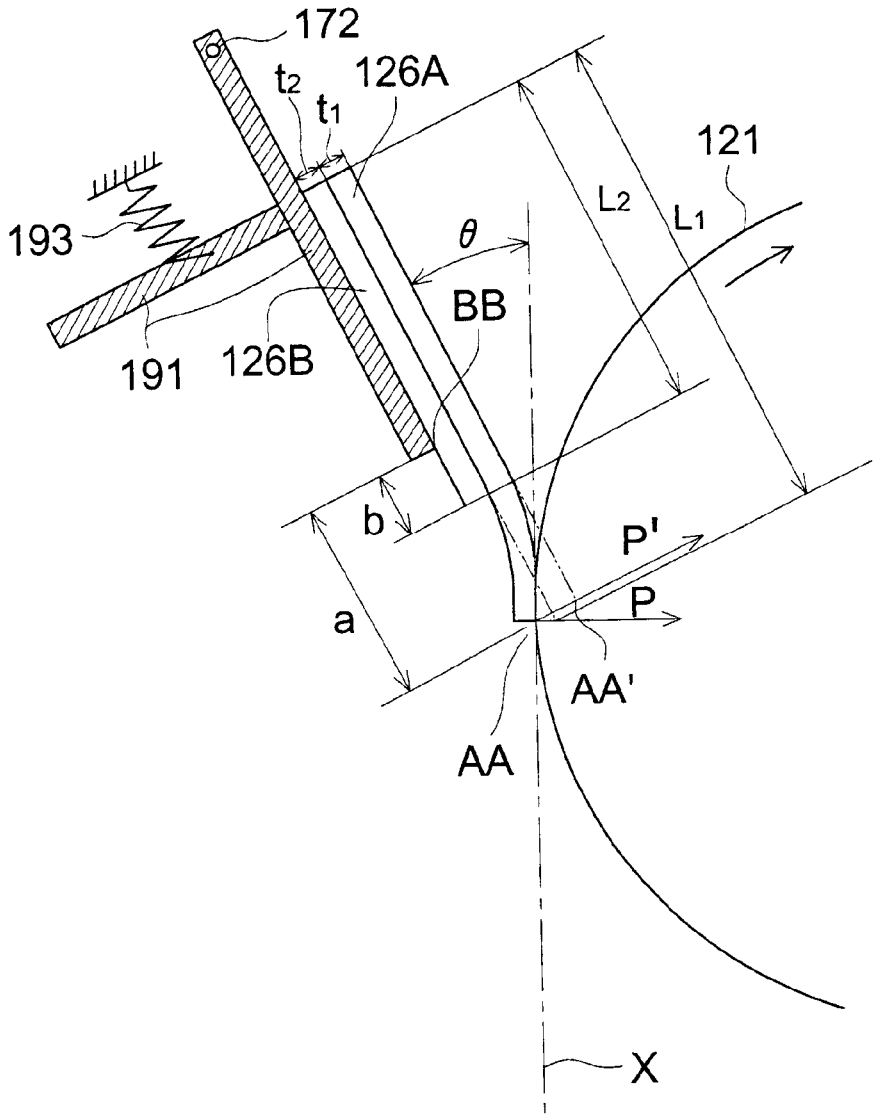
FIG. 2 is a view showing a configuration of a cleaning unit employing the first blade member of the present invention.

FIG. 2 is a schematic view of a cleaning unit employing the first blade member of the present invention.

In said cleaning unit, first blade member 126A and second blade member 126B are attached to support 191. Employed as a material of both said first blade member and said second blade member is an elastic rubber material. Usable as materials are urethane rubber, silicone rubber, fluorine rubber, chloroprene rubber, butadiene rubber, and the like. Of these, urethane rubber is particularly preferred due to its excellent wear resistance compared to other rubber materials. For example, preferred are urethane rubber described in Japanese Patent Publication Open to Public Inspection No. 59-30574, which is obtained by allowing polycaprolactone ester to react with polyisocyanate followed by hardening, and the like.

In the present invention, when said second blade member 126B, as well as said first blade member 126A, is attached onto support member 191, said second blade member is arranged so as to be brought into close contact with the surface of the photoreceptor opposite to its surface which is brought into contact with said first blade member, followed by being attached and maintained. At that time, the section, in which said first blade member is brought into contact with said second blade member, possesses a mechanism which is capable of securely transferring vibration generated at said blade to said second blade member and allows said second blade member to absorb the vibration. By employing the positioning method as described above, it is possible to allow said second blade member effectively to absorb the vibration of said first blade member, and thus it is possible to stabilize the vibration of said blade.

The optimal pressure contact conditions of the first blade member onto the photoreceptor surface are determined depending on a delicate balance among various properties and exhibit a narrow range. Said conditions vary depending on the properties of the first blade member such as thickness and the like. Thus the conditions are determined to high accuracy. However, the production of first blade members is inevitably accompanied with slight fluctuation of their thickness. Therefore, it is difficult to maintain the optimal conditions at all times. Even though the optimal conditions are initially set, during use, the resultant conditions may deviate from the optimal range due to its narrow range. When combined specifically with an organic photosensitive layer employing a binder having a high molecular weight, the deviation from the optimal range causes blade curl as well as the residual toner.

Accordingly, it is necessary to take some measures to minimize the fluctuation of properties of the second blade member and the first blade member, and the like. Even though the thickness of the first blade member may fluctuate, it may be necessary to employ a setting method which does not affect the pressure contact force against the photoreceptor surface and the like.

In the present invention, the edge portion of a first blade member is preferably brought into pressure contact with the photoreceptor surface in such a manner that load is applied to said edge in the opposite direction (the counter direction) to the rotation direction of the photoreceptor. As shown in FIG. 2, when the edge portion of the first blade member is brought into pressure contact with the photoreceptor, a pressure contact area is preferably formed.

As shown in FIG. 2, the first blade member and the second blade member of the present invention are positioned so that a level difference is provided between both edges. Further, the free length of the second blade member is shorter than that of the first blade member. By employing such a configuration, without hindering the deformation (the deformation due to pressure contact with the photoreceptor) at the end portion of the first blade member, and further by allowing the elastic body to absorb the vibration of the first blade member, it is possible to stabilize the vibration of the first blade member.

The cleaning unit of the present invention comprises a cleaning blade which is composed of the first blade member and the second blade member. The first member is brought into contact with the surface of the photoreceptor. The blade may be composed of three or more elastic member. In this instance the second blade member is designated as the member provided outermost side from the first blade member. Therefore the third member is imposed between the first and the second blade members when the blade is composed of three elastic members.

Each of the elastic members which compose the blade is preferably plane plate when it is free. Each of the thickness measured at 10 points of the plane plate is preferably within 15% of the average thickness of the plate.

The length of the first blade member $L_1$ is longer than that of the second blade member $L_2$, as demonstrated in FIG. 2.

The preferable example of the blade is composed of two elastic members laminated to each other.

The ratio of the free length of the first blade member to that of the second blade member satisfies Formula 1, wherein as shown in FIG. 2, "a" is the free length of the first blade member and "b" is the free length of the second blade member. The free length as described herein means the length of each portion of the first blade member and the second blade member which is not held by the support member. As shown in FIG. 2, the free length of the first blade member "a" is the length from end BB of support member 191 to the end of the first blade member prior to its deformation and the free length of the second blade member "b" is the length from said end BB to the end of the second blade member.

$$0.1<b/a\leqq 0.9 \qquad \text{Formula 1}$$

It has been discovered that the blade satisfies the ratio b/a in said range, namely b/a exceeds 0.1 and is not more than 0.9, without hindering the deformation (the deformation due to pressure contact against the photoreceptor) of the end portion of the first blade member, and further by allowing the second blade member to absorb the vibration of the first blade member, it is possible to realize uniform cleaning properties which result in neither blade curl nor residual toner, which is not removed. Further, in the present invention, the range is set more preferably between 0.3 and 0.8, and is set most preferably between 0.5 and 0.6. On the other hand, when b/a is not more than 0.1, the toner tends not to be removed, while when b/a is more than 0.9, blade curling tends to result.

The cleaning unit of the present invention has the ratio of the thickness of the first blade member to that of the second blade member satisfies Formula 2, wherein as shown in FIG. 2, $t_1$ is the thickness of the first blade member and $t_2$ is the thickness of the second blade member:

$$1/30<t_2/t_1<2 \qquad \text{Formula 2}$$

It has been discovered that by satisfying the ratio $t_2/t_1$ in said range, namely $t_2/t_1$ exceeds 1/30 and is less than 2, the first blade member is held stably by the support member and any vibration of the first blade member is absorbed by the second blade member, and thus it is possible to realize consistent cleaning properties which result in neither blade curl nor residual toner which is not removed. Further, the ratio of $t_2/t_1$ is preferably between 1/8 and 5/4, and is most preferably between 1/4 and 3/4. On the other hand, when $t_2/t_1$ is not more than 1/30, the toner tends not to be removed, while when $t_2/t_1$ is more than 2, blade curl tends to be caused.

In the present invention, contact load P and contact angle θ of said first blade member against the photoreceptor are preferably 5 to 40 N/m and 5 to 90 degrees, respectively. The contact angle θ is more preferably 5 to 60 degree, and particularly preferably 10 to 35 degree, and contact load P is more preferably 10 to 30 N/m.

Said contact load P is a vector value in the normal direction of pressure contact force P', when blade 126A comes into contact with drum 121.

Further, said contact angle θ represents the angle of tangent X at contact point AA of the photoreceptor to the blade prior to deformation. In FIG. 2, the end point of the first blade member is shown by AA' when the blade is not brought into contact with the photoreceptor. Numeral 172 is a screw which secures the'support member, and 193 is a load spring.

Further, as shown in FIG. 2, free length "a" of said first blade member represents the length from end BB of support member 191 to the end of the first blade member prior to deformation. Said free length "a" is preferably between 6 and 15 mm. The thickness of said first blade member is preferably between 0.5 and 10 mm. Herein, as shown in FIG. 2, the thickness of the first blade member and of the second blade member of the present invention is perpendicular to the contact surface of support 191.

The blade keeps preferably accuracy within 10 μm at the edge portion which is brought into contact with the photoreceptor. For this purpose the first blade member and the second blade member are laminated by such a way that the second blade member and the support are mounted on the first blade member while the edge of the first blade member is butted to a member having accuracy within 1 μm. The other way is that the second blade member is fixed to the blade support having accuracy within 10 μm, then the first blade member is laminated to the second blade member.

The adhesives means employed in laminating the plate materials are not restricted particularly and examples thereof include polyamide or urethane hot melt adhesives, epoxy or phenol adhesives, or double-sided tape. Thickness of the adhesives is preferably 0.005 to 1 mm.

The first blade member and the second blade member, employed in the present invention, are preferably comprised of an elastic rubber material. By simultaneously controlling its physical properties of rubber hardness as well as impact resilience, it is possible to more preferably adjust each condition of the present invention and to effectively control the cleaning properties for the toner.

The cleaning unit of the present invention has hardness $K_1$ and second blade member hardness $K_2$, specified by JIS A "Hardness", satisfy Formula 3.

$$5/7<K_2/K_1<10/7 \qquad \text{Formula 3}$$

It has been discovered that the first blade member is stably held by the support member and any vibration of the first blade member is absorbed by the second blade member, and thus it is possible to realize consistent cleaning properties which result in neither blade curl nor residual toner which is not removed when $K_2/K_1$ exceeds 5/7 and is less than 10/7. Further, the value of $K_2/K_1$ is preferably between 11/14 and 9/7, and is most preferably between 13/14 and 15/14. On the other hand, when $K_2/K_1$ is not more than 5/7, toner tends not to be removed, while when $K_2/K_1$ is no less than 10/7, blade curl tends to result.

The impact resilience $H_1$ of the first blade member and impact resilience $H_2$ of the second blade member satisfies Formula 4. The impact resilience, as described herein, is an index which represents the coefficient of restitution in which a colliding or falling body rebounds. Specifically, measurement is carried out based on JIS K 6301-1975 Physical Test Method of Vulcanized Rubber (JIS K 6301 10. Impact Resilience Test). The numerical figure of the impact resilience is expressed as percent. Incidentally, the aforementioned JIS A "Hardness" is measured in the same manner as based on JIS K 6301 Physical Test Method of Vulcanized Rubber.

$$2/7<H_2/H_1<8/7 \qquad \text{Formula 4}$$

The first blade member is stably held by the support member and any vibration of the first blade member is absorbed by the second blade member, when $H_2/H_1$ exceeds 2/7 and is not more than 8/7 and thus it is possible to realize consistent cleaning properties which result in neither blade curl nor residual toner which is not removed. Further, the ratio of $H_2/H_1$ is more preferably between 3/7 and 8/7, and is most preferably between 5/7 and 1. On the other hand, when $H_2/H_1$ is not more than 2/7, toner tends not to be removed, while when $H_2/H_1$ exceeds 8/7, blade curl tends to occur.

Preferable H1 is 0.1 to 0.7 kg/mm$^2$.

The hardness of the first blade member is preferably 55 to 90 at 25±5° C. in terms of JIS A "Hardness". When the hardness is not more than 55, the cleaning performance tends to be degraded, while when the hardness is no less than 90, the blade tends to be inverted. Further, the impact resilience of the first blade member is preferably 25 to 80. When the impact resilience exceeds 80, the blade tends to be inverted. When the impact resilience is less than 25, cleaning performance is deteriorated. Young's modulus of the blade is preferably 294 to 588 N/cm$^2$.

Further, if desired, it is preferable that fluorine based lubricants are sprayed onto the end portion of the first blade member which comes in contact with the photoreceptor, or further applied onto the whole said end portion along the width of the blade, which is prepared by dispersing fluorine based polymer and fluorine based resin powder into a fluorine based solvent.

The organic photoreceptors of the present invention will now be described.

In the present invention, the electrophotographic organic photoreceptors (hereinafter referred simply to as organic photoreceptors), as described herein, mean electrophotographic photoreceptors which are comprised of organic compounds having at least either a charge generating function or a charge transport function, which are essential to constitute electrophotographic photoreceptors, and include all electrophotographic organic photoreceptors known in the art such as photoreceptors comprised of organic charge generating materials or organic charge transport materials known in the art, photoreceptors in which a charge generating function as well as a charge transport function is exhibited, employing polymer complexes.

The organic photoreceptors employed in the present invention will now be described.

Electrically Conductive Support

Employed as electrically conductive supports may be those which are either in sheet or in cylindrical form. However, in order to make an image forming apparatuses small-sized, an electrically conductive cylindrical support is more preferred.

The electrically conductive cylindrical support as described in the present invention means a cylindrical support which is capable of endlessly forming images through its rotation, and the electrically conductive support is preferred which has a circularity of not more than 0.1 mm and a deviation of not more than 0.1 mm. When said circularity as well said deviation exceeds said limits, it becomes difficult to form consistently excellent images.

Employed as electrically conductive materials may be metal drums comprised of aluminum, nickel, and the like, plastic drums vacuum coated with aluminum, tin oxide, indium oxide, and the like, or paper-plastic drums coated with these kinds of electrically conductive materials. Said electrically conductive supports preferably exhibit a specific resistance of $10^3$ Ωcm or more.

The electrically conductive support employed in the present invention may have an anodized aluminum film on its surface, which is subjected to sealing. An anodized aluminum treatment is generally carried out in an acid bath such as, for example, chromic acid, sulfuric acid, oxalic acid, phosphoric acid, boric acid, sulfamic acid, and the like. Of these, anodic oxidation in sulfuric acid provides the most preferable results. The anodic oxidation in sulfuric acid is preferably carried out under conditions of a sulfuric acid concentration of 100 to 200 g/liter, an aluminum ion concentration of 1 to 10 g/liter, a solution temperature of about 20° C., and an applied voltage of 20 V. However, said conditions are not limited to these cited ones. Further, the average thickness of the resultant anodic oxidation film is generally not more than 20 μm, and is most preferably not more than 10 μm.

Interlayer

In the present invention, it is possible to provide an interlayer having a barrier function between the electrically conductive support and the photosensitive layer.

In the present invention, in order to improve adhesion between the electrically conductive support and said photosensitive layer, or to minimize charge injection from said support, it is possible to provide an interlayer (including a sublayer) between said support and said photosensitive layer. Listed as materials of said support are polyamide resins, vinyl chloride resins, vinyl acetate resins, and copolymer resins comprising at least two repeating units of these resins. Of these subbing resins, polyamide resins are preferable as the resins which are capable of minimizing an increase in residual potential accompanied under repeated use. Further, the thickness of the interlayer comprised of these resins is preferably between 0.01 and 2 μm.

Further, listed as an interlayer, which is most preferably employed, is that comprised of hardenable metal resins which are subjected to thermal hardening employing organic metal compounds such as silane coupling agents, titanium coupling agents, and the like. The thickness of the interlayer comprised of said hardenable metal resins is preferably between 0.1 and 2 μm.

Photosensitive Layer

The photosensitive layer configuration of the photoreceptor of the present invention may be one comprised of a single layer structure on said interlayer, which exhibits a charge generating function as well as a charge transport function. However, a more preferable configuration is that the photosensitive layer is comprised of a charge generating layer (CGL) and a charge transport layer (CTL). By employing said configuration in which the functions are separated, it is possible to control an increase in residual potential, accompanied under repeated use at a low level, and to readily control the other electrophotographic properties to desired values. A negatively charged photoreceptor is preferably composed in such a manner that applied onto the interlayer is the charge generating layer (CGL), onto which the charge transport layer is applied. On the other hand, a positively charge photoreceptor is composed so that the order of the layers employed in the negatively charged photoreceptor is reversed. The most preferable photosensitive layer configuration is the negatively charged photoreceptor configuration having said function separation structure.

The photosensitive layer configuration of a function separated negatively charged photoreceptor is now described.

Charge Generating Layer

The charge generating layer comprises charge generating materials (CGM). As to other materials, if desired, binder resins and other additives may be incorporated.

Employed as charge generating materials may be those commonly known in the art. For example, employed may be phthalocyanine pigments, azo pigments, perylene pigments, azulenium pigments, and the like. Of these, CGMs, which are capable of minimizing the increase in residual potential, accompanied under repeated use, are those which comprise a three-dimensional electrical potential structure capable of taking stable agglomerated structure between a plurality of molecules. Specifically listed are CGMs of phthalocyanine pigments and perylene pigments having a specific crystal structure. For instance, titanyl phthalocyanine having a maximum peak at 27.2° of Bragg angle 2θ with respect to a Cu—Kα line, benzimidazole perylene having a maximum peak at 12.4° of said Bragg 2θ, and the like, result in minimum degradation under repeated use and can minimize the increase in residual potential.

When in the charge generating layer, binders are employed as the dispersion media of CGM, employed as binders may be any of the resins known in the art. Listed as the most preferable resins are formal resins, butyral resins, silicone resins, silicone modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As to other materials, if desired, also incorporated may be additives such as antioxidants and the like.

Employed as charge transfer materials (CTM) may be any of those known in the art. For example, it is possible to employ triphenylamine derivatives, hydrazone compounds, styryl compounds, benzidine compounds, butadiene compounds, and the like. These charge transport materials are commonly dissolved in appropriate binder resins and are then subjected to film formation. of these, CTMs, which are capable of minimizing the increase in residual potential under repeated use, are those which exhibit properties such as high mobility as well as an ionization potential difference of not more than 0.5 eV, and preferably not more than 0.25 eV from a combined CGM.

The ionization potential of CGM and CTM is measured employing a Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors, such as poly-N-vinylcarbazole.

The most preferable as CTL binders are polycarbonate resins. Polycarbonate resins are most preferred because the dispersibility of CTM as well as electrophotographic properties is improved. In the case of the photoreceptor in which the charge transport layer is employed as the surface layer, polycarbonates which exhibit high mechanical wear resistance are preferred and polycarbonates having an average molecular weight of at least 40,000 are also preferable. The ratio of binder resins to charge transport materials is preferably between 10 and 200 weight parts per 100 weight parts of the binder resins. Further, the thickness of the charge transport layer is preferably between 10 and 40 $\mu$m.

Protective Layer

Provided as protective layers of a photoreceptor may be various types of resinous layers. Specifically, it is possible to obtain the photoreceptor having high mechanical strength of the present invention by providing a cross linked resinous layer.

Listed as solvents or dispersion media which are employed to form layers such as photosensitive layers, protective layers, and the like, are n-butylamine, diethylamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dicholorethane, 1,2-dichloropropane, 1,1,2-trichloroethane, 1,1,1-trichloroethane, trichloroethylene, tetrachloroethane, tetrahydrofuran, dioxysolan, dioxane, methanol, ethanol, butanol, isopropanol, ethyl acetate, butyl acetate, dimethyl sulfoxide, methyl cellosolve, and the like. However, the present invention is not limited to these examples, and also preferably employed are dichloromethane, 1,2-dicholorethane, methyl ethyl ketone, and the like. Further, these solvents may be employed individually or in combination as a solvent mixture of two or more types.

Employed as coating methods to produce electrophotographic organic photoreceptors of the present invention are dip coating, spray coating, circular amount regulating type coating, and the like. When an upper layer is applied onto the photosensitive layer, preferably employed coating methods such as spray coating or circular amount-regulating type coating (including a circular slide hopper type as its representative example) and the like so that the dissolution of the lower layer is minimized and uniform coating is achieved. Incidentally, the protective layer of the present invention is most preferably applied employing said circular amount-regulating type coating method. Said circular amount-regulating type coating is detailed in, for example, Japanese Patent Publication Open to Public Inspection No. 58-189061.

Described next will be the toner which is employed in the present invention.

Preferred as the toner of the present invention is a polymerized toner in which the size distribution of individual toner particles as well as their shape is relatively uniform. The polymerized toner as described herein means a toner obtained in such a manner that binder resins for the toner as well the shape of toner particles are formed by polymerization of monomers as the raw materials of the binder resins followed by chemical treatment. More specifically, said polymerized toner means the toner which is obtained by polymerization such as suspension polymerization, emulsion polymerization and the like, if desired, followed by a fusing process among particles which is carried out after said polymerization.

Preferred as the polymerized toner which is employed in the cleaning unit employing the first blade member of the present invention is one having a specific shape of toner particles. The polymerized toner, which may preferably be employed in the present invention, will be described below.

The polymerized toner, which is preferably employed in the present invention, has a number ratio of toner particles having a shape coefficient of 1.2 to 1.6 and is at least 65 percent, and further the variation coefficient of said shape coefficient is not more than 16 percent. In the present invention, it has been discovered that even though such a polymerized toner is employed, it is possible to stabilize the vibration of the first blade member, and excellent cleaning performance is exhibited.

Further, the stability of the vibration of the first blade member is dependent on the diameter of toner particles. As the diameter of particles decrease, adhesion of toner particles to the image bearing body increases. As a result, the resultant vibration tends to become excessive, and toner particles are more likely not to be removed by the first blade member. On the other hand, toner particles, having a larger diameter, are more readily removed by the first blade member. However, problems occur in which image quality such as resolution, and the like, is degraded.

Investigation was carried out based on the aforementioned viewpoints. As a result, it has been discovered that by employing a toner having a variation coefficient of the toner shape coefficient of not more than 16 percent, as well as having a number variation coefficient in the toner number size distribution of not more than 27 percent, high image quality, which is exhibited by excellent cleaning properties, as well as excellent fine line reproduction, can be obtained over an extended period of time.

Further, by employing a toner in which the number ratio of toner particles, having no corners, is set at 50 percent and the number variation coefficient in the number size distribution is adjusted to not more than 27 percent, it is possible to obtain high image quality over an extended time of period, which exhibits excellent cleaning properties, as well as excellent fine line reproduction.

The shape coefficient of the toner particles of the present invention is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by Nihon Denshi Co. At that time, 100 toner particles were employed and the shape coefficient of the present invention was obtained employing the aforementioned calculation formula.

The polymerized toner of the present invention is that the number ratio of toner particles in the range of said shape coefficient of 1.2 to 1.6 is preferably at least 65 percent and is more preferably at least 70 percent.

By adjusting the number ratio of toner particles in the range of a shape coefficient of 1.2 to 1.6 to at least 65 percent, the triboelectrical properties become more uniform on the developer conveying member resulting in no accumulation of excessively charged toner particles, and said toner particles are more readily replaced from the surface of said developer conveying member to minimize the generation of problems such as development ghost and the like. Further, the toner particles tend not to be crushed, resulting in decreased staining on the charge providing member and chargeability of the toner is stabilized.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

The variation coefficient of the polymerized toner, which is preferably employed in the present invention, is calculated using the formula described below:

$$\text{Variation coefficient}=(S/K)\times 100 \text{ (in percent)}$$

wherein S represents the standard deviation of the shape coefficient of 100 toner particles and K represents the average of said shape coefficient.

Said variation coefficient of the shape coefficient is generally not more than 16 percent, and is preferably not more than 14 percent. By adjusting said variation coefficient of the shape coefficient to not more than 16 percent, voids in the transferred toner layer decrease to improve fixability and to minimize the formation of offsetting. Further, the resultant charge amount-distribution narrows to improve image quality.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Iyodenshi Co.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100 \text{ (in percent)}$$

wherein S represents the standard deviation in the number particle size distribution and $D_n$ represents the number average particle diameter (in $\mu$m).

The number variation coefficient of the toner of the present invention is not more than 27 percent, and is preferably not more than 25 percent. By adjusting the number variation coefficient to not more than 27 percent, voids of the transferred toner layer decrease to improve fixability and to minimize the formation of offsetting. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in-the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

The toner particles of the present invention, which substantially have no corners, as described herein, mean those having no projection to which charges are concentrated or which tend to be worn down by stress. Namely, as shown in FIG. 13(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 13(*b*) and 13(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Further, decreased are toner particles which are readily worn and broken, as well as those which have a portion at which charges are concentrated. Thus, since the charge amount distribution is narrowed, it is possible to stabilize chargeability, resulting in excellent image quality over an extended period of time.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The diameter of the toner particles of the present invention is preferably between 3 and 8 $\mu$m in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 $\mu$m, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76. . .). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 $\mu$m (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

Of methods to control the shape coefficient, the polymerized toner method is preferable since it is simple as well as convenient as a toner production method, the surface uniformity is excellent compared to pulverized toner, and the like.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

Incidentally, the water based medium as described in the present invention means one in which at least 50 percent, by weight of water, is incorporated.

Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating . After completing the reaction, the dispersion stabilizers are removed, filtered, washed, and subsequently dried. In this manner, the toner of the present invention is prepared.

Further, listed as a method for preparing said toner may be one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

Employed coagulants are not particularly limited, but those selected from metal salts are more suitable. Specifically, listed as univalent metal salts are salts of alkaline metals such as, for example, sodium, potassium, lithium, and the like; listed as bivalent metal salts are salts of alkali earth metals such as, for example, calcium, magnesium, and salts of manganese, copper, and the like; and listed as trivalent metal salts are salts of iron, aluminum, and the like. Listed as specific salts may be sodium chloride, potassium chloride, lithium chloride, calcium chloride, zinc chloride, copper sulfate, magnesium sulfate, manganese sulfate, and the like. These may also be employed in combination.

These coagulants are preferably added in an amount higher than the critical coagulation concentration. The critical coagulation concentration as described herein means an index regarding the stability of water based dispersion and concentration at which coagulation occurs through the addition of coagulants. Said critical coagulation concentration markedly varies depending on emulsified components as well as the dispersing agents themselves. Said critical coagulation concentration is described in, for example, Seizo Okamura, et al., "Kobunshi Kagaku (Polymer Chemistry) 17", 601 (1960) edited by Kobunshi Gakkai, and others. Based on said publication, it is possible to obtain detailed critical coagulation concentration. Further, as another method, a specified salt is added to a targeted particle dispersion while varying the concentration of said salt; the $\xi$ potential of the resultant dispersion is measured, and the critical coagulation concentration is also obtained as the concentration at which said $\xi$ potential varies.

The acceptable amount of the coagulating agents of the present invention is an amount of more than the critical coagulation concentration. However, said added amount is preferably at least 1.2 times as much as the critical coagulation concentration, and is more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

Incidentally, in order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the,resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like.

Employed as charge control agents may also be various types of those which are known in the art and can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof.

Incidentally, it is preferable that the number average primary particle diameter of particles of said charge control agents as well as said fixability improving agents is adjusted to about 10 to about 500 nm in the dispersed state.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention. Reaction apparatuses, which are preferably employed in the present invention, will now be described.

Figure 3:
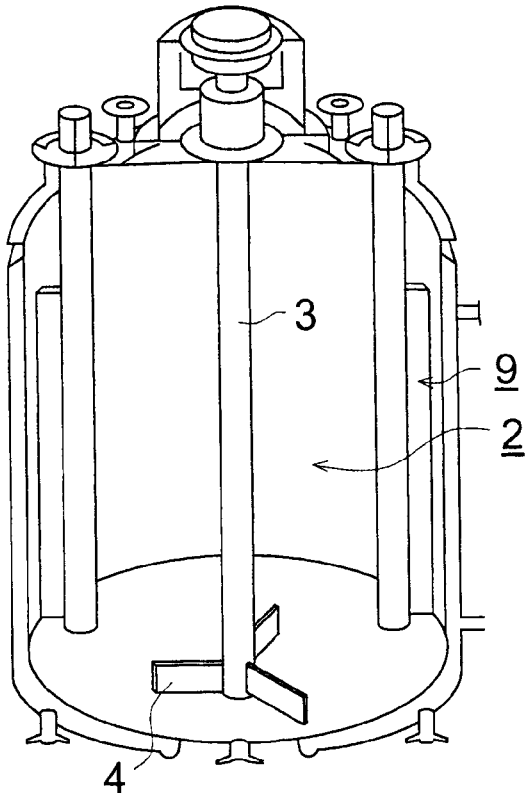
FIG. 3 is a view explaining a reaction apparatus having one level configuration of the stirring blade.

FIG. 3 is an explanatory view showing a commonly employed reaction apparatus (a stirring apparatus) in which stirring blades are installed at one level, wherein reference numeral 2 is a stirring tank, 3 is a rotation shaft, 4 are stirring blades, and 9 is a turbulent flow inducing member.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 3, the medium in stirring tank 2 flows only from the bottom part to the upper part along the wall. Due to that, a conventional turbulent flow is commonly formed and stirring efficiency is enhanced by installing turbulent flow forming member 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 4:
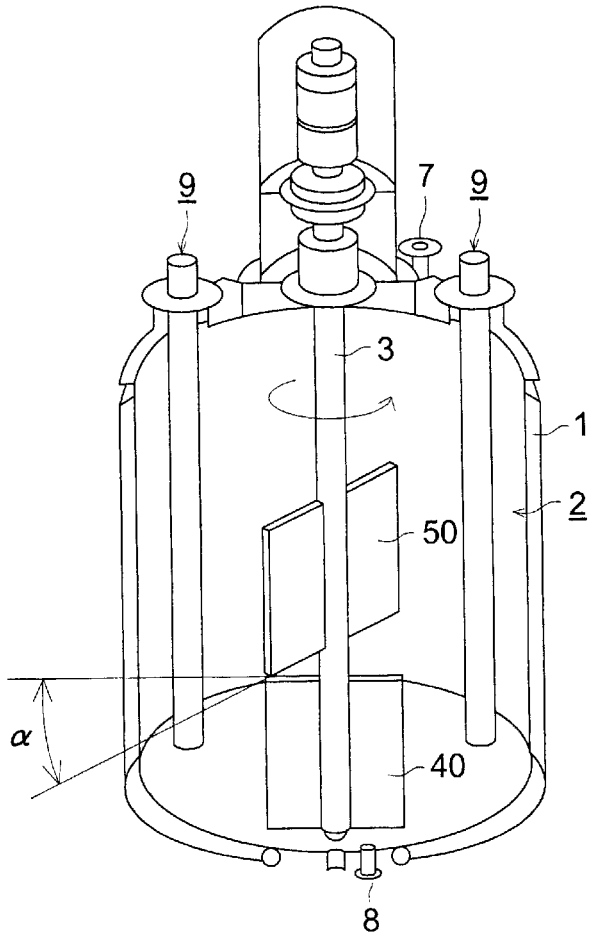
FIG. 4 is a perspective view showing one example of a reaction apparatus which is provided with preferably employable stirring blades.
Figure 5:
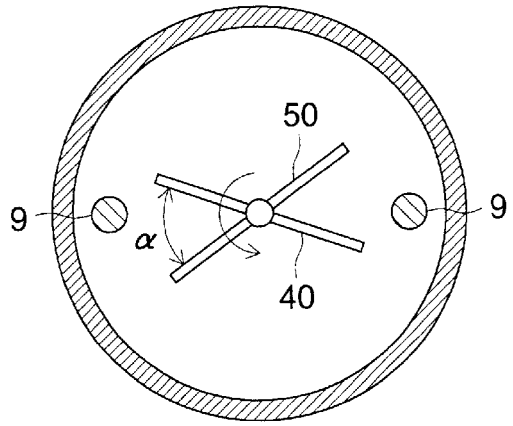
FIG. 5 is a cross-sectional view of the reaction apparatus shown in FIG. 4.

FIGS. 4 and 5 are a perspective view and a cross-sectional view, of the reaction apparatus described above, respectively. In the reaction apparatus illustrated in FIGS. 4 and 5, rotating shaft 3 is installed vertically at the center in vertical type cylindrical stirring tank 2 of which exterior circumference is equipped with a heat exchange jacket, and said rotating shaft 3 is provided with lower level stirring blades 40 installed near the bottom surface of said stirring tank 40 and upper level stirring blade 50. The upper level stirring blades 50 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as described above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by said stirring blades 50 themselves, as a whole, accelerating the flow. As a result, it is further assumed that since a flow area is formed which has large shearing stress in the turbulent flow, it is possible to control the shape of the resultant toner.

Incidentally, in FIGS. 4 and 5, arrows show the rotation direction, reference numeral 7 is upper material charging inlet, 8 is a lower material charging inlet, and 9 is a turbulent flow forming member which makes stirring more effective.

Figure 12:
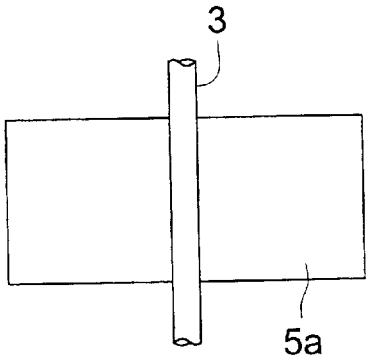
FIGS. 12(*a*), 12(*b*), 12(*c*) and 12(*d*) are views showing specific examples of the shape of a stirring blade.
Figure 12:
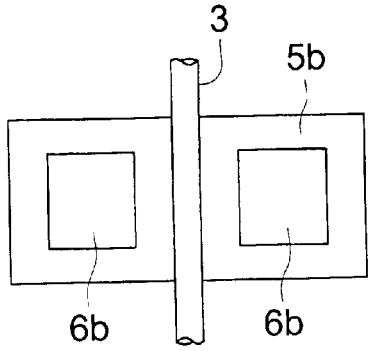
Figure 12:
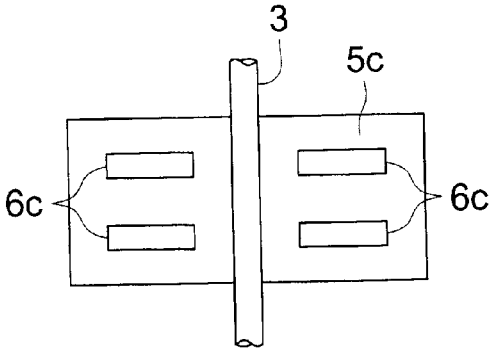
Figure 12:
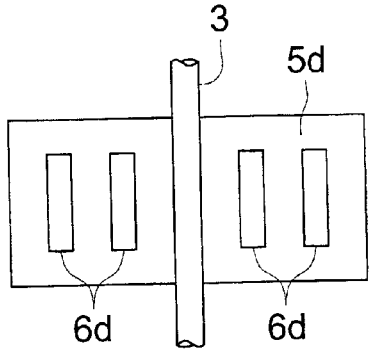

Herein, the shape of the stirring blades is not particularly limited, but employed may be those which are in square plate shape, blades in which a part of them is cut off, blades having at least one opening in the central area, having a so-called slit, and the like. FIG. 12 describes specific examples of the shape of said blades. Stirring blade 5*a* shown in FIG. 12(*a*) has no central opening; stirring blade 5*b* shown in FIG. 12(*b*) has large central opening areas 6*b*; stirring blade 5*c* shown in FIG. 12(*c*) has rectangular openings 6*c* (slits); and stirring blade 5*d* shown in FIG. 12(*d*) has oblong openings 6*d* shown in FIG. 12(*d*). Further, when stirring blades of a three-level configuration are installed, openings which are formed at the upper level stirring blade and the openings which are installed in the lower level may be different or the same.

FIGS. 6 through 10 each show a perspective view of a specific example of a reaction apparatus equipped with stirring blades which may be preferably employed. In FIGS. 6 through 10, reference numeral 1 is a heat exchange jacket, 2 is a stirring tank, 3 is a rotation shaft, 7 is an upper material charging inlet, 8 is a lower material charging inlet, and 9 is a turbulent flow forming member.

Figure 6:
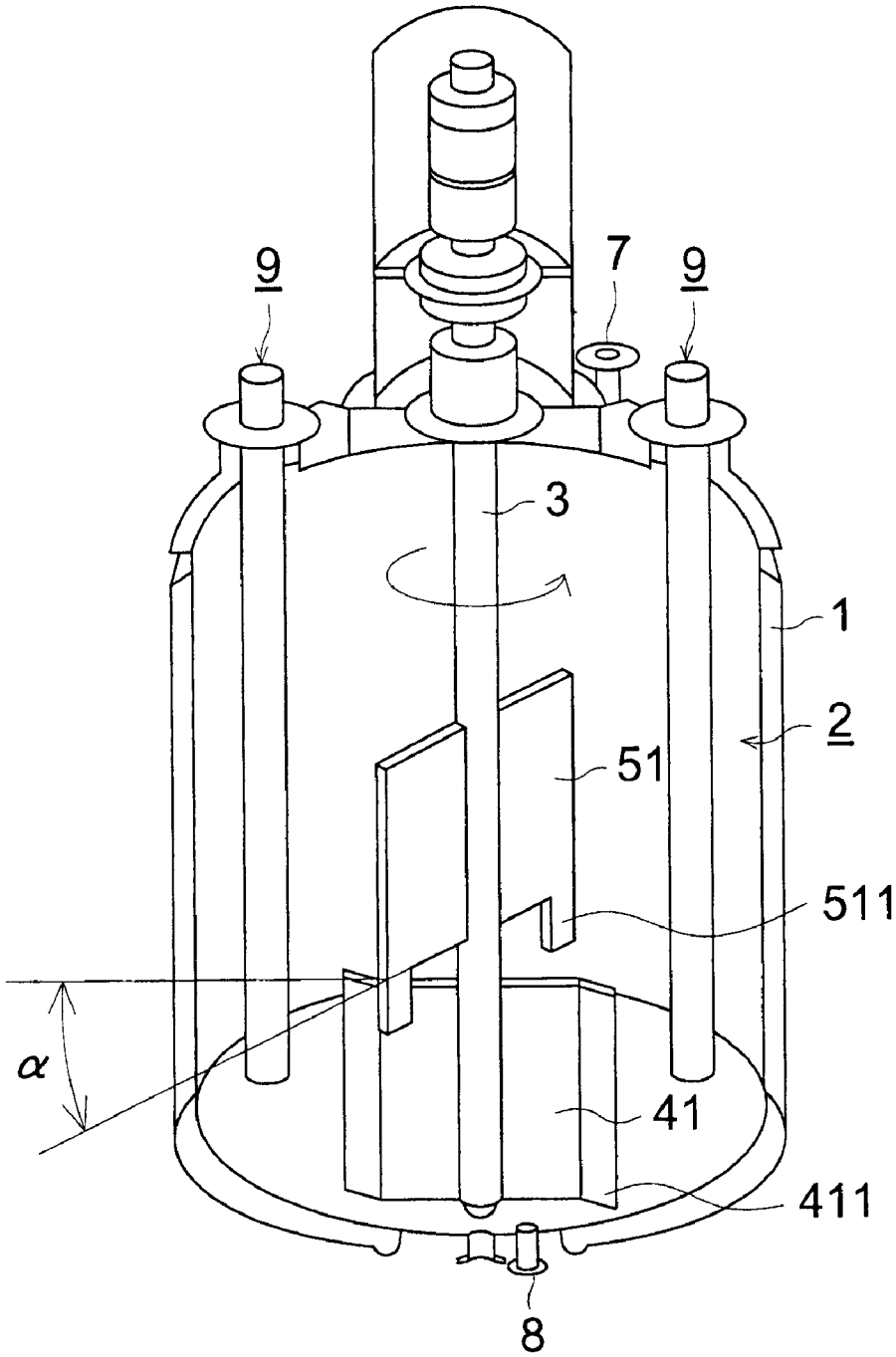
FIG. 6 is a perspective view showing a specific example of a reaction apparatus provided with the preferably employable stirring blades.

In the reaction apparatus shown in FIG. 6, folded parts 411 are formed on stirring blade 42 and fins 511 (projections) are formed on stirring blade 51.

Further, when said folded sections are formed, the folded angle is preferably between 5 and 45 degrees.

Figure 7:
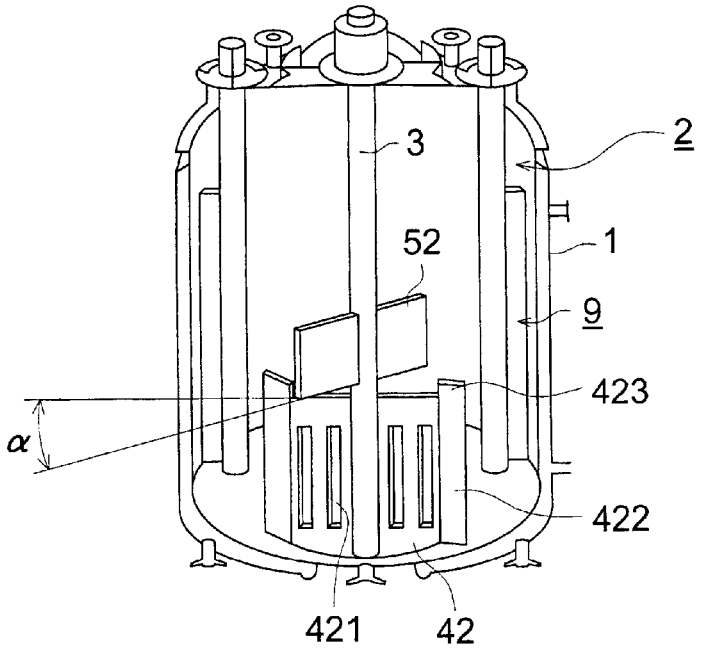
FIG. 7 is a perspective view showing a specific example of a reaction apparatus provided with the preferably employable stirring blades.

In stirring blade 42 which constitutes the reaction apparatus shown in FIG. 7, slits 142, folded sections 422, and fins 423 are formed simultaneously.

Further, stirring blade 52, which constitute part of the reaction apparatus, has the same shape as stirring blade 50 which constitutes part of the reaction apparatus shown in FIG. 4.

Figure 8:
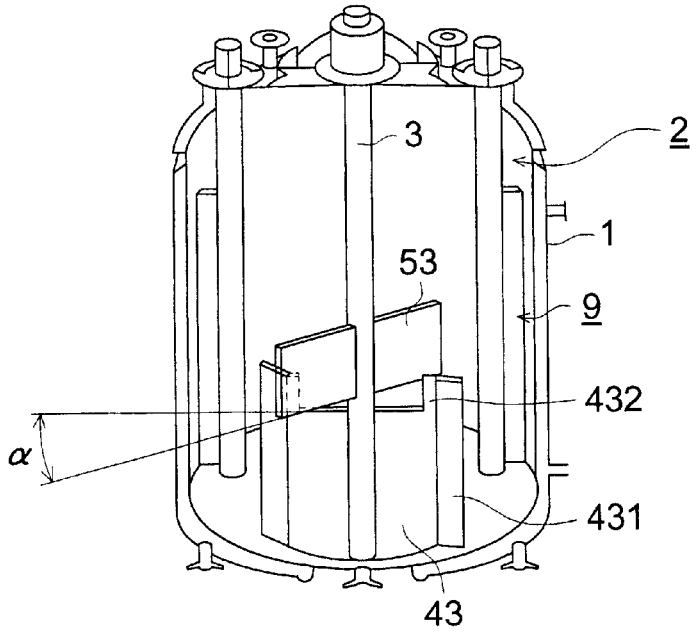
FIG. 8 is a perspective view showing a specific example of a reaction apparatus provided with the preferably employable stirring blades.

In stirring blade 43 which constitutes part of the reaction apparatus shown in FIG. 8, folded section 431 as well as fin 432 is formed.

Further, stirring blade 53, which constitutes part of said reaction apparatus, has the same shape as stirring blade 50 which constitutes part of the reaction apparatus shown in FIG. 4.

Figure 9:
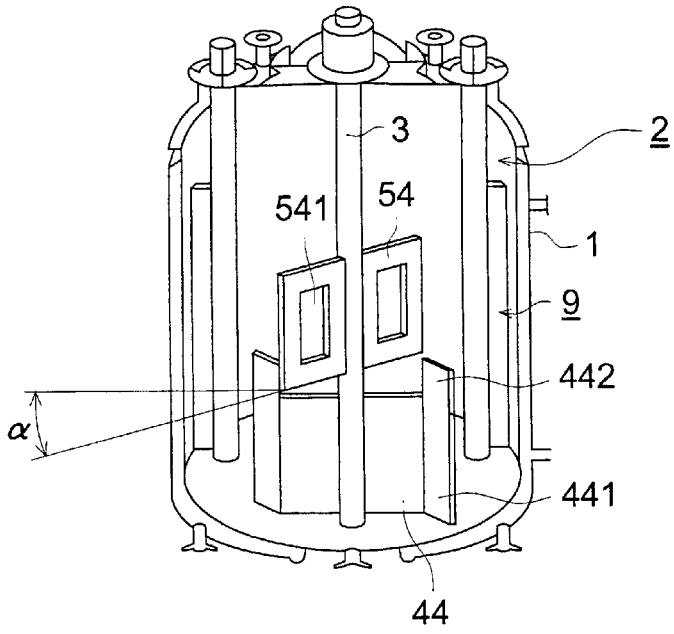
FIG. 9 is a perspective view showing a specific example of a reaction apparatus provided with the preferably employable stirring blades.

In stirring blade 44 which constitutes part of the reaction apparatus shown in FIG. 9, folded section 441 as well as fin 442 is formed.

Further, in the stirring blade 54 which constitutes part of said reaction apparatus, openings 541 are formed in the center of the blade.

Figure 10:
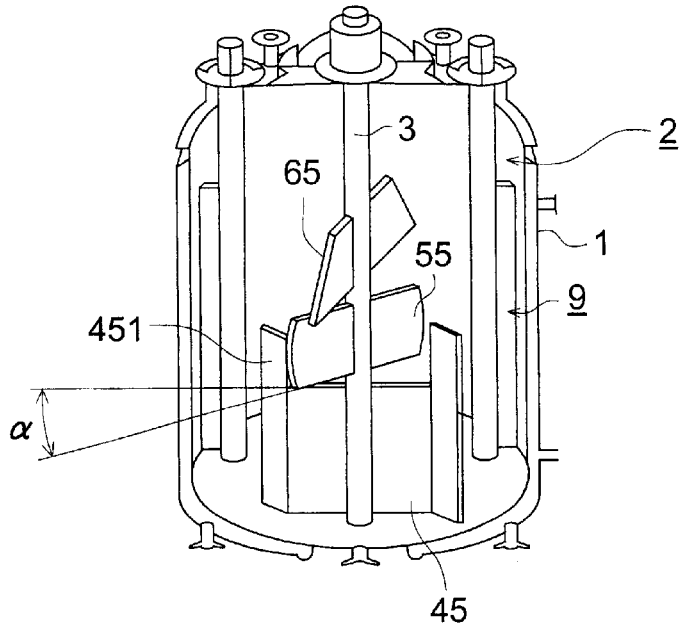
FIG. 10 is a perspective view showing a specific example of a reaction apparatus provided with the preferably employable stirring blades.

In the reaction apparatus shown in FIG. 10, provided are stirring blades at three-level comprised of stirring blade 45 (at the lower level), stirring blade 55 (at the middle level), and stirring blades 65 at the top are provided.

Stirring blades having such folded sections, stirring blades which have upward and downward projections (fins), all generate an effective turbulent flow.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

Figure 11:
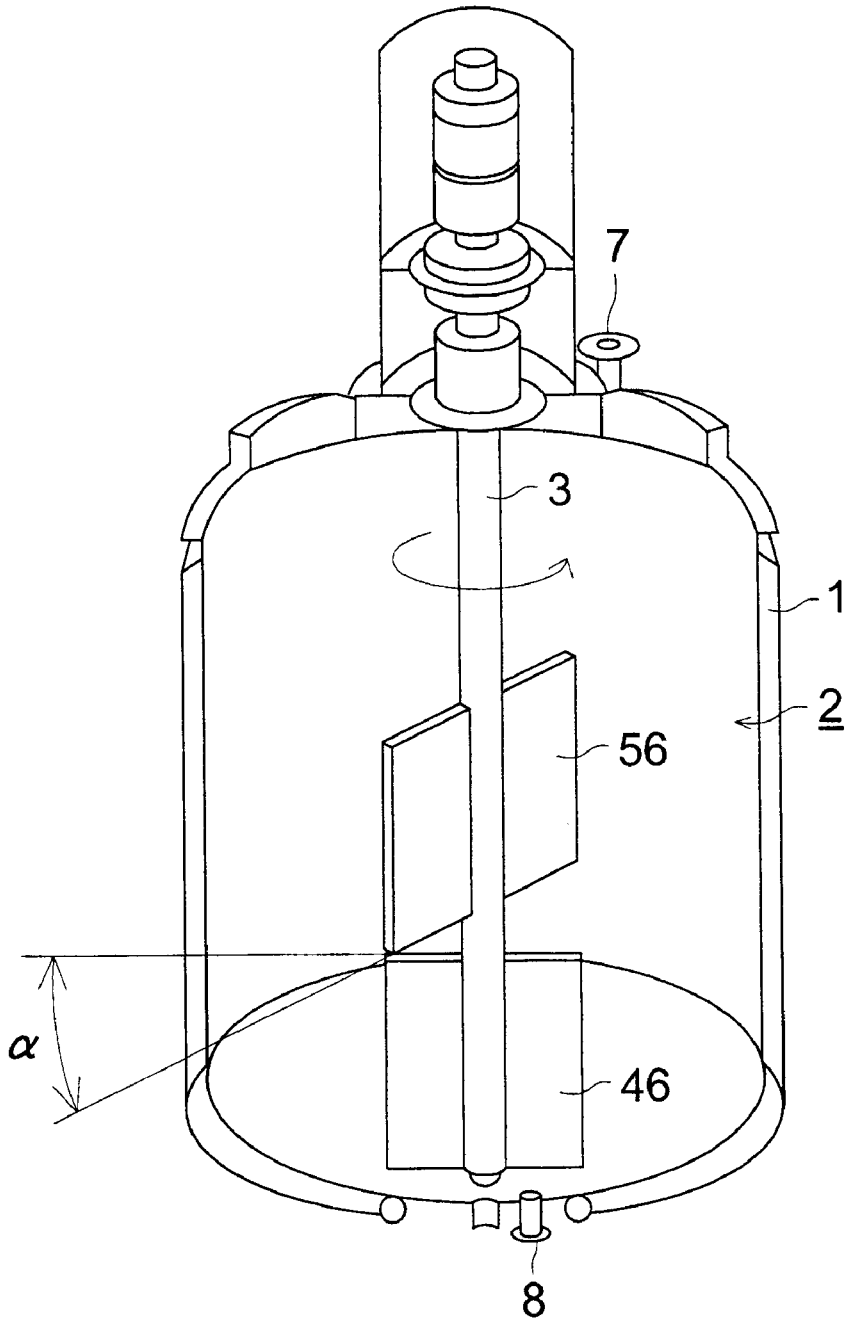
FIG. 11 is a perspective view showing one example of a reaction apparatus employed so that a laminar flow forms.

Still further, FIG. 11 shows one example of a reaction apparatus employed when a laminar flow is formed in the suspension polymerization method. Said reaction apparatus is characterized in that no turbulent flow forming member (obstacles such as a baffle plate and the like) is provided.

Stirring blade 46, as well as stirring blade 56, has the same shape as well as the crossed axis angle of stirring blade 40, as well as stirring blade 50 which constitutes part of the reaction apparatus shown in FIG. 4. In FIG. 11, reference numeral 1 is a heat exchange jacket, 2 is a stirring tank, 3 is a rotation shaft, 7 is an upper material charging inlet, and 8 is a lower material charging inlet.

Incidentally, apparatuses, which are employed to form a laminar flow, are not limited to ones shown in FIG. 11.

Further, the shape of stirring blades, which constitute part of said reaction apparatuses, is not particularly limited as long as they do not form a turbulent flow, but rectangular plates and the like which are formed with a continuous plane are preferable and may have a curved plane.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

Namely, in a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are associated or fused, can be the same stirring blades and stirring tank which are employed in said suspension polymerization in which the laminar flow is formed, and for example, it is possible to employ the apparatus shown in FIG. 11. Said apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle $\alpha$ in advance in the rotation direction with respect to the lower stirring blade.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 12(*a*), which are formed of a continuous plane are preferable, and those having a curved plane may also be employed.

Further, the toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

Employed as external additives which are used in the present invention may be fatty acid metal salts. Cited as fatty acids and salts thereof are long chain fatty acids such as undecylic acid, lauric acid, tridecyl acid, dodecyl acid, myristic acid, palmitic acid, pentadecylic acid, stearic acid, heptadecylic acid, arachic acid, montanic acid, oleic acid, linoleic acid, arachidonic acid, as well as their salts of metals such as zinc, iron, magnesium, aluminum, calcium, sodium, lithium and the like. In the present invention, zinc stearate is particularly preferable.

A double component developer is prepared by mixing a toner with a carrier. The concentration of the toner in the developer is to be between 2 and 10 percent by weight, and the resultant developer is employed.

Development methods according to the present invention are not particularly limited. A contact development method may be employed in which development is carried out in such a manner that the photoreceptor surface comes into contact with the developer layer, and a non-contact development method may also by employed in which the photoreceptor surface and the developer layer are maintained in a non-contact state, and development is carried out by allowing the toner jump in the space between the photoreceptor surface and the developer layer, employing means such as an alternating electrical field and the like.

EXAMPLES

The present invention will now be detailed with reference to examples. However, the embodiments of the present invention are not limited to these examples. Incidentally, "parts" in the description means "parts by weight", unless otherwise specified.

The photoreceptors, which are employed in the present invention, are prepared as described below.

Preparation of Photoreceptor P1

Placed into a solvent comprised of 90 ml of methanol and 100 ml of 1-butanol were 30 g of polyamide resin Amiran CM-8000 (manufactured by Toray), and were dissolved at 30° C. The resultant solution was applied onto a 360 mm long cylindrical aluminum electrically conductive support. Thus a 0.5 mm thick interlayer was formed.

Subsequently, 10 g of silicone resin KR-5240 (manufactured by Shin-Etsu Kagaku Co.) were dissolved in 1,000 ml of t-butyl acetate. The resultant solution was blended with 10 g of Y-TiOPc (described in FIG. 1 of Japanese Patent Publication Open to Public Inspection No. 64-17066), and the resultant mixture was dispersed for 20 hours employing a sand mill. Thus a charge generating layer coating composition was obtained. Said composition was applied onto said interlayer, and thus a 0.3 μm thick charge generating layer was formed.

Next, 150 g of CMT (T-1: N-(4-methylphenyl)-N-{4-(β-phenylstyryl)phenyl}-p-toluidine) and 200 g of polycarbonate resin, TS-2050, having a viscosity average molecular weight of 50,000 (manufactured by Teijin Kagaku Co., Ltd.) were dissolved in 1,000 ml of 1,2-dichloroethane and a charge transport layer coating composition was thus prepared. After applying said composition onto said charge generating layer employing a circular slide hopper, the coated layer was dried at 100° C. for one hour, and a 22 μm thick charge transport layer was formed. As described above, Photoreceptor P1 was obtained, which was comprised of the interlayer, the charge generating layer, and the charge transport layer.

Preparation of Photoreceptor P2

Applied onto said charge transport layer of the photoreceptor sample (P1), which was obtained in the production example of Photoreceptor P1, was a coating composition prepared by dissolving 30 g of CTM (T-1) and 50 g of polycarbonate resin, Ubiron Z-800, having a viscosity average molecular weight of 80,000 (manufactured by Mitsubishi Gas Kagaku Co.) in 1,000 ml of 2-dichloroethane, employing a circular slide hopper. Thereafter, the coated layer was dried at 100° C. for one hour to form a 5 μm thick overcoat layer. Thus Photoreceptor P2 was obtained.

Preparation of Photoreceptor P3

On the charge generating layer of the production example of Photoreceptor P1, a charge transport layer coating composition was obtained by dissolving 150 g of CTM (T-1) and 200 g of polycarbonate resin, Ubiron Z-800, having a viscosity average molecular weight of 80,000 (manufactured by Mitsubishi Gas Kagaku Co.) in 1,000 ml of 2-dichloroethane. After said composition was applied onto each of said charge generating layers, the coated layer was dried at 100° C. for one hour to form a 22 μm thick charge transport layer. As described above, Photoreceptor P3 was obtained which was comprised of the interlayer, the charge generating layer, and the charge transport layer.

Toner employed in the present invention was prepared as described below.

Production of Toners T1 and T2 (Example of Emulsion Polymerization Method)

Added to 10.0 liters of pure water was 0.90 kg of sodium dodecyl sulfate, which was dissolved while stirring. Gradually added to the resultant solution were 1.20 kg of Regal 330R (carbon black, manufactured by Cabot Co.), and stirred well for one hour. Thereafter, the resultant mixture was continuously dispersed for 20 hours, employing a sand grinder (a medium type homogenizer). The resultant dispersion was designated as "Colored Dispersion 1". Further, a solution comprised of 0.055 kg of sodium dodecylbenzenesulfonate and 4.0 liters of deionized water was designated as "Anionic Surface Active Agent Solution A".

A solution comprised of 0.014 kg of nonyl phenyl polyethylene oxide 10-mole addition product and 4.0 liters of deionized water was designated as "Nonionic Surface Active Solution B". A solution prepared by dissolving 223.8 g of potassium persulfate in 12.0 liters of deionized water was designated as "Initiator Solution C".

Placed into a 100-liter GL (glass lining) reaction tank, fitted with a thermal sensor, a cooling pipe, and a nitrogen gas introducing device, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution A", and all of "Nonionic Surface Active Agent B", and the resultant mixture was stirred. Subsequently, 44.0 liters of deionized water were added.

When the mixture was heated to 75° C., all of "Initiator Solution C" was added dropwise. Thereafter, while maintaining the temperature of the mixture at 75±1° C., 12.1 kg of styrene, 2.88 kg of n-butyl acrylate, 1.04 kg of methacrylic acid, and 548 g of t-dodecylmercaptan were added dropwise. After finishing dropwise addition, the mixture was heated to 80±1° C. and stirred for 6 hours while being heated. Subsequently the resultant mixture was cooled to not more than 40° C., and stirring was terminated. Said mixture was filtered employing a pole filter and the resultant filtrate was designated as "Latex (1)-A".

Incidentally, the glass transition temperature of resinous particles in Latex (1)-A was 57° C., and the softening point of the same was 121° C. The molecular weight distribution of the same exhibited parameters such as a weight average molecular weight of 12,700 and a weight average particle diameter of 120 nm.

Further, a solution, prepared by dissolving 0.055 kg of sodium dodecylbenzene sulfonate in 4.0 liters of deionized water, was designated as "Anionic Surface Active Agent Solution D". Still further, a solution prepared by dissolving 0.014 kg of nonyl phenol polyethylene oxide 10-mole added product in 4.0 liters of deionized water was designated as "Nonionic Surface Active Agent Solution E".

A solution, prepared by dissolving 200.7 g of potassium persulfate (manufactured by Kanto Kagaku Co.) in 12.0 liters of deionized water, was designated as "Initiator Solution F".

Placed into a 100-liter GL reaction tank, fitted with a thermal sensor, a cooling pipe, a nitrogen gas introducing device, and a comb-shaped baffle, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution D", and all of "Nonionic Surface Active Agent E", and the resultant mixture was stirred. Subsequently, 44.0 liters of deionized water were added. When the mixture was heated to 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. Thereafter, while maintaining the temperature of the mixture at 72±2° C., stirring was carried out for 6 hours while being heated. The temperature was further raised to 80±2° C., and stirring was carried out for 12 hours while being heated. The resultant solution was cooled to not more than 40° C., and stirring was terminated. Filtration was carried out employing a pole filter, and the resultant filtrate was designated as "Latex (1)-B.

Incidentally, the glass transition temperature of resinous particles in Latex (1)-B was 58° C., and the softening point of the same was 132° C. The molecular weight distribution of the same exhibited parameters such as a weight average molecular weight of 245,000 and a weight average particle diameter of 110 nm.

A solution, prepared by dissolving 5.36 kg of sodium chloride as the salting-out agent in 20.0 liters of deionized water, was designated as "Sodium Chloride Solution G".

A solution, prepared by dissolving 1.00 g of a fluorine based nonionic surface active agent in 1.00 liter of deionized water, was designated as "Nonionic Surface Active Agent Solution H".

Placed into a 100-liter SUS reaction tank, fitted with a thermal sensor, a cooling pipe, a nitrogen gas introducing device, and a particle diameter and shape monitoring device (a reaction apparatus which is shown in FIG. 11 in which the crossed axis angle $\alpha$ is set at 20 degrees) were 20.0 kg of Latex (1)-A and 5.2 kg of Latex (1)-B prepared as described above, 0.4 kg of colorant dispersion, and 20.0 kg of deionized water and the resultant mixture was stirred. Subsequently, said mixture was heated at 40° C., which was added to Sodium Chloride Solution G, 6.00 kg of isopropanol (manufactured by Kanto Kagaku Co.) and Nonionic Surface Active Agent Solution H in said order. Thereafter, the mixture was set aside for 10 minutes and then heated to 85° C. over 60 minutes. At 85±2° C., the mixture was stirred from 0.5 to 3 hours, so that the particle diameter increased under salting-out/fusion. Subsequently, 2.1 liters of pure water was added, to terminate the increase in the particle diameter.

Placed into a 5-liter reaction vessel, fitted with a thermal sensor, a cooling pipe, and a particle diameter and shape monitoring device (Being the reaction apparatus which is shown in FIG. 11 in which the crossed axis angle $\alpha$ is set at 20 degrees) were 5.0 kg of the fused particle dispersion prepared as described above, and the shape was controlled while stirring at the dispersion temperature of 85±2° C. from 0.5 to 15 hours. Thereafter, the resultant dispersion was cooled to not more than 40° C. and stirring was terminated. Subsequently, classification was carried out in the suspension by a centrifugal sedimentation method employing a centrifuge, and the resultant mixture was filtered employing a 45 $\mu$m opening sieve. The resultant filtrate was designated as Association Liquid (1). Subsequently, wet cake-like non-spherical particles were collected from said Association Liquid (1) through filtration, employing glass filter and then washed with deionized water.

The resultant non-spherical particles were dried employing a flash jet drier at an intake air temperature of 60° C., and subsequently dried at 60° C., employing a fluidized-bed dryer. Externally blended with 100 parts, by weight, of the obtained colored particles were one part by weight of fine silica particles and 0.1 part by weight of zinc stearate, employing a Henschel mixer, and thus toners shown in the table below were obtained which were prepared employing the emulsion polymerization association method. Toner T1 as well as Toner T2 shown in Table 1 was obtained by controlling the stirring rotation rate and the heating time during monitoring of said salting-out/fusion stage as well as the shape controlling process, and further by adjusting the particle diameter and the variation coefficient of the grain size distribution.

Production of Toner T3 (Example of Suspension Polymerization Method)

A mixture consisting of 165 g of styrene, 35 g of n-butyl acrylate, 10 g of carbon black, 2 g of di-t-butylsalicylic acid metal compound, 8 g of styrene-methacrylic acid copolymer, and 20 g of paraffin wax (having an mp of 70° C.) was uniformly dissolved and dispersed at 12,000 rpm, employing TK Homomixer (manufactured by Tokushu Kikakogyo Co.). Added to the resultant mixture were 10 g of 2,2'-azobis(2,4-valeronitrile) and dissolved to prepare a polymerizable monomer composition. Subsequently, added to 710 g of deionized water were 450 g of 0.1 M aqueous sodium phosphate solution, and while stirring the resultant mixture at 13,000 rpm employing TK Homomixer, 68 g of 1.0 M calcium chloride were gradually added. Thus, a suspension, in which tricalcium phosphate was dispersed, was prepared. Added to the resultant suspension was said polymerizable monomer composition and the resultant mixture was stirred at 10,000 rpm for 20 minutes, employing TK Homomixer. Thus said polymerizable monomer composition was granulated. Thereafter, the granulated composition underwent reaction at 75 to 95 ° C. from 5 to 15 hours, employing a reaction apparatus having stirring blades (having a crossed axis angle of 45 degrees) structured as shown in FIG. 4. Subsequently, tricalcium phosphate was removed employing hydrochloric acid, and classification was then carried out in the liquid employing a centrifuge. Subsequently, filtering, washing and drying were carried out. Externally added to 100 weight parts of said obtained colored particles were one weight part of fine silica particle and 0.1 weight part of zinc stearate, employing a Henschel mixer. Thus obtained was a toner, which was prepared employing the suspension polymerization method.

Toner T3, which is shown in Table 1 described below, was obtained by carrying out monitoring during said polymerization, controlling the shape as well as the variation coefficient of the shape coefficient by controlling the temperature of said suspension, the rotation rate of stirring, and the heating time, and further by adjusting the particle diameter as well as the variation coefficient of the particle size distribution.

TABLE 1

| Toner No. | Ratio of Shape Coefficient of 1.0 to 1.6 (in percent) | Ratio of Shape Coefficient of 1.2 to 1.6 (in percent) | Variation Coefficient of Shape Coefficient (in percent) | Ratio of Toner Particles having no Coroners (in percent) | Number Average Particle Diameter (in $\mu$m) | Variation Coefficient of Number Distribution (in percent) | Sum M of $m_1$ and $m_2$ (in percent) | Production Method |
|---|---|---|---|---|---|---|---|---|
| Toner 11 | 76.6 | 72.0 | 14.9 | 53 | 6.4 | 26.2 | 77.0 | emulsion polymerization association |
| Toner 12 | 75.7 | 70.6 | 15.3 | 58 | 6.3 | 25.8 | 78.1 | emulsion polymerization association |
| Toner 13 | 89.5 | 76.9 | 14.8 | 61 | 8.9 | 26.6 | 77.8 | suspension polymerization |

Preparation of Developer

Preparation of Developer 1

Mixed with 100 parts of said T1 were 0.4 part of hydrophobic silica particles having an average particle diameter of 12 nm (R805, manufactured by Nihon Aerosil Co.) and 0.6 part of titania particles (T805, manufactured by Nihon Aerosil Co.), and the resultant mixture was blended at room temperature at a peripheral stirring blade rate of 40 m/second for 10 minutes to obtain a negatively charged toner. The sticking ratio of the resultant toner was 45 percent.

A ferrite carrier having a volume average particle diameter of 60 $\mu$m, which had been coated with silicon resins, was blended with said toner, and Developer 1, having a toner concentration of 5 percent, was prepared.

Preparation of Developers 2 and 3

Developer 2 was repapered in the same manner as Developer 1, except that in the preparation of said Developer 1, Toner T1 was replaced with Toner T2, while Developer 3 was also prepared in the same manner, except that Toner T1 was replaced with Toner T3.

The first blade member as well as the second blade member which is employed in the cleaning unit of the present invention is described in the examples. Primarily employed as said first blade members, as well as said second blade member, were commercially available products. However, those, which were not commercially available, were prepared employing newly prepared urethane rubber.

Said new urethane rubber was prepared as follows. Employed as raw materials of urethane prepolymers were ethylene adipate based prepolymers (having an Mn of 2,000 and an NCO ratio of 6 percent). Blended with said prepolymers were 4-butanediol and trimethylolpropane, while optionally varying the blending ratio, and the resultant mixture was poured into a die which had been preheated and was thermally hardened. Thus second blade members, having various different hardness and impact resilience, were prepared, and molded. After molding, resultant products were cut and machined to specified width, thickness and length.

Said second blade member, as well as said first blade member, was adhered onto a support plate employing a hot-melt adhesive, and first blade members employed in examples were obtained.

Example 1

Conditions of Example

Photoreceptor: P1

Developer: 1 (Toner: T1)

First blade member: rubber hardness of 70°, rubber having an impact resilience of 30 percent (manufactured by Hokushin Kogyo Co.) and a thickness $t_1$ of 2.0 mm Second blade member: the same material as the first blade member, having a thickness $t_2$ of 1.5 mm Variation of the free length of the second blade member and first blade member Configuration: as shown in FIG. 2, the second blade member and the first blade member were adhered onto a support member. The free length "a" of the first blade member as well as the free length "b" of the second blade member was varied as shown in Tables 2 and 3.

Other Cleaning Conditions

First blade member contact angle: 20°

First blade member load (N/m): 25 N/m

Evaluation of Cleaning Properties

As shown in Tables 2 and 3, the free length of the first blade member and the second blade member was optionally varied, and by employing a digital copier, Konica 7050, (comprising processes utilizing corona charging, laser beam exposure, reversal development, electrostatic transfer, claw separation, and a first blade member), which basically has image forming processes in described in FIG. 1., was carried out evaluation of toner which was not removed by the first blade member, blade curl, blade noise, and image unevenness. The evaluation was carried out in such a manner that employing an original comprised of equal quarters of each of a text image having a pixel ratio of 7 percent, a halftone photographic image, a solid white image, and a solid black image, copying experiments were continuously carried out at normal temperature and normal humidity (24° C. and 60 percent RH) at a copying rate of 50 A4 sheets/minute for 90 minutes. Incidentally, prior to the beginning of said evaluation, in order to allow the photoreceptor as well as the first blade member to adapt to processing, setting powder was scattered onto both surfaces and the photoreceptor was allowed to rotate for one minute. Other conditions for image evaluation are described below. Tables 2 and 3 show the evaluation results.

Other Conditions for Evaluation

Further, set as other evaluation conditions to employ said 7050 were conditions described below.

Charging Conditions

Charging unit: Scorotron charging unit, in which the initial electrostatic potential was set at −750 V.

Exposure Conditions

Exposure amount was set so that electric potential at the exposed part was −750 V Development Conditions DC bias: −550 V Dsd: 550 μm Developer layer regulation: edge cut system Developer thickness: 700 μm Developing sleeve diameter: 40 mm Transfer Conditions Transfer pole: corona charging system, transfer dummy electric current value: 45 μA Evaluation Items and Evaluation Criteria Non-removed toner A: non-removed development toner was observed B: 0 to 20 percent of development toner was not removed C: 20 to 50 percent of development toner was not removed D: at least 50 percent of development toner was not removed.

Blade curl

Time when the blade curl occurred was noted.

Blade noise

Abnormal noise which was generated by abnormal friction between the first blade member and the photoreceptor was designated as blade noise. The presence and absence of said abnormal noise was recorded.

Evaluation of Image Quality (presence/absence of image uneveneness

During said continuous copying of the halftone photographic image for 90 minutes, the formation of image unevenness was evaluated.

TABLE 2

| | | | | | | | |
|---|---|---|---|---|---|---|---|
| a (in mm) | 9 | 9 | 9 | 9 | 9 | 9 | 9 |
| b (in mm) | 1.8 | 2.7 | 4.5 | 5.4 | 6.3 | 7.2 | 8.1 |
| b/a | 0.2 | 0.3 | 0.5 | 0.6 | 0.7 | 0.8 | 0.9 |
| Blade Curl | not formed | not formed | not formed | not formed | not formed | not formed | not formed |
| Non-removed Toner | A | A | A | A | A | A | A |

TABLE 3

| | | | | | | | |
|---|---|---|---|---|---|---|---|
| a (in mm) | 5 | 5 | 5 | 5 | 5 | 5 | 5 |
| b (in mm) | 1.0 | 1.5 | 2.5 | 3.0 | 3.5 | 4.0 | 4.5 |
| b/a | 0.2 | 0.3 | 0.5 | 0.6 | 0.7 | 0.8 | 0.9 |
| Blade Curl | not formed | not formed | not formed | not formed | not formed | not formed | not formed |
| Non-removed Toner | A | A | A | A | A | A | A |

The similar experiment was conducted by modifying the first and second blades. The result is summarized in Table 2' and Table 3'.

First blade member: rubber hardness of 60°, rubber having an impact resilience of 30 percent (manufactured by Hokushin Kogyo Co.) and a thickness $t_1$ of 2.0 mm Second blade member: rubber hardness of 88°, rubber having an impact resilience of 70 percent (manufactured by Hokushin Kogyo Co.) and a thickness $t_2$ of 3.0 mm

TABLE 2'

| | | | |
|---|---|---|---|
| a (in mm) | 9 | 9 | 9 |
| b (in mm) | 0.45 | 0.9 | 9 |
| b/a | 0.05 | 0.1 | 1.0 |
| Blade Curl | not formed | not formed | formed after 15 minutes |
| Non-removed Toner | C | B | A |

TABLE 3'

| | | | |
|---|---|---|---|
| a (in mm) | 5 | 5 | 5 |
| b (in mm) | 0.25 | 0.5 | 5 |
| b/a | 0.05 | 0.1 | 1.0 |
| Blade Curl | not formed | not formed | formed after 8 minutes |
| Non-removed Toner | D | B | A |

As can clearly be seen from Tables 2, 2', 3 and 3', when the free length of the second blade member as well as the first blade member satisfies the conditions of Formula 1, that is $0.1<b/a\leqq 0.9$, neither non-removed toner nor the blade noise was formed and excellent cleaning properties were exhibited. In addition, no formation of the image unevenness was observed. On the other hand, when either $0.1\geqq b/a$ or $b/a>0.9$ is held, any of non-removed toner and blade curl occurred.

Example 2

Conditions of Example

Photoreceptor: P2

Developer: 2 (Toner: T2)

First blade member: rubber hardness of 70°, rubber having an impact resilience of 60 percent (manufactured by Hokushin Kogyo Co.) and a free length "a" of 9 mm Second blade member: the same material as the first blade member, having a free length "b" of 5.4 mm Configuration: As shown in FIG. 2, the second blade member and the first blade member were adhered onto the support member.

Thickness $t_1$ of the first blade member as well as thickness $t_2$ of the second blade member was varied as shown in Tables 4.

First blade member contact angle: 20°

First blade member load (N/m): 20 N/m

Evaluation of Cleaning Properties

As shown in Table 4, the thickness of the first blade member as well as the second blade member was varied, and by employing a digital copier Konica 7050 (comprising processes utilizing corona charging, laser beam exposure, reversal development, electrostatic transfer, claw separation, and first blade member) which basically had image forming processes in described in FIG. 1., were carried out evaluation of cleaning properties of toner which was not removed by the first blade member, blade curl, blade noise. Further, the image unevenness during continuous copying was evaluated. Table 4 shows the evaluation results.

TABLE 4

| | | | | | | | |
|---|---|---|---|---|---|---|---|
| $t_1$ (in mm) | 2 | 2 | 2 | 2 | 2 | 2 | 2 |
| $t_2$ (in mm) | 0.1 | 0.5 | 1 | 1.5 | 2 | 2.5 | 3 |
| $t_2/t_1$ | 1/20 | 1/4 | 1/2 | 3/4 | 1 | 5/4 | 3/2 |
| Blade Curl | not formed | not formed | not formed | not formed | not formed | not formed | not formed |
| Non-removed Toner | A | A | A | A | A | A | A |

The similar experiment was conducted by modifying the first and second blades. The result is summarized in Table 4'.

First blade member: rubber hardness of 60°, rubber having an impact resilience of 30 percent (manufactured by Hokushin Kogyo Co.) and a free length "a" of 10 mm Second blade member: rubber hardness of 88°, rubber having an impact resilience of 70 percent (manufactured by Hokushin Kogyo Co.) and a free length "a" of 1.0 mm Configuration: As shown in FIG. 2, the second blade member and the first blade member were adhered onto the support member.

Thickness $t_1$ of the first blade member as well as thickness $t_2$ of the second blade member was varied as shown in Tables 4'.

TABLE 4'

| | | | |
|---|---|---|---|
| $t_1$ (in mm) | 2 | 2 | 2 |
| $t_2$ (in mm) | 0.07 | 4 | 5 |
| $t_2/t_1$ | 1/30 | 2 | 5/2 |
| Blade Curl | not formed | formed after 20 minutes | formed after 6 minutes |
| Non-removed Toner | C | A | A |

As can clearly be seen from Tables 4 and 4', when the free length of the second blade member, as well as of the first blade member, satisfies the conditions of Formula 2, that was $1/30<t_2/t_1<2$, non-removed toner, blade noise, and image unevenness did not result. On the other hand, when either $1/30 \geqq t_2/t_1$ or $t_2/t_1 \geqq 2$ held true, non-removed toner and blade curl was observed.

Example 3

Conditions of Example

Photoreceptor: P3

Developer: 3 (Toner: T3)

First blade member: rubber hardness of 70°, rubber having an impact resilience of 60 percent (manufactured by Hokushin Kogyo Co.), free length "a" of 9 mm, and thickness $t_1$ of 2 mm Second blade member: the second blade member, having free length "b" of 5.4 mm and thickness $t_2$ of 1.5, mm was employed of which rubber hardness was varied as described in Table 5.

Configuration: As shown in FIG. 2, the second blade member and the first blade member were adhered onto the support member.

The hardness of the second blade member was varied as shown in Table 5.

First blade member contact angle: 20°

First blade member load (N/m): 20 N/m

Evaluation of Cleaning Properties

As shown in Table 5, the hardness of the second blade member was varied, and by employing a digital copier, Konica 7050 (comprising processes utilizing corona charging, laser beam exposure, reversal development, electrostatic transfer, claw separation, and first blade member) which basically had image forming processes in described in FIG. 1., was carried out for evaluation of toner which was not removed by the first blade member, blade curl, blade noise, and the image unevenness. Evaluation conditions were the same as Example 1. Table 5 shows the evaluation results.

TABLE 5

| | | | | | | | |
|---|---|---|---|---|---|---|---|
| $K_1$ | 70 | 70 | 70 | 70 | 70 | 70 | 70 |
| $K_2$ | 55 | 60 | 65 | 70 | 75 | 80 | 90 |
| $K_2/K_1$ | 11/14 | 6/7 | 13/14 | 1 | 15/14 | 8/7 | 9/7 |
| Blade Curl | not formed | not formed | not formed | not formed | not formed | not formed | not formed |
| Non-removed Toner | A | A | A | A | A | A | A |

The similar experiment was conducted by modifying the first and second blades. The result is summarized in Table 5'.

First blade member: rubber hardness of 30°, rubber having an impact resilience of 60 percent (manufactured by Hokushin Kogyo Co.), free length "a" of 10 mm, and thickness $t_1$ of 1 mm Second blade member: rubber hardness of 70°, rubber having an impact resilience of 60 percent (manufactured by Hokushin Kogyo Co.), free length "a" of 10 mm, and thickness $t_2$ of 3 mm free length "b" of 1 mm

TABLE 5'

| | | | |
|---|---|---|---|
| $K_1$ | 70 | 70 | 70 |
| $K_2$ | 45 | 50 | 100 |
| $K_2/K_1$ | 9/14 | 5/7 | 10/7 |
| Blade Curl | not formed | not formed | formed after 20 minutes |
| Non-removed Toner | C | B | A |

As can clearly be seen from Table 5 and Table 5', when the hardness of the second blade member, as well as the first blade member satisfies the conditions of Formula 3, that is $5/7<K_2/K_1<10/7$, neither blade curl nor non-removed toner resulted and further, excellent cleaning properties were exhibited and also no image unevenness was formed. On the other hand, when either $7 \geqq K_2/K_1$ or $K_2/K_1 \geqq 2$ held true, either non-removed toner or blade curl resulted.

Example 4

Conditions of Example

Photoreceptor: P1

Developer: 3 (Toner: T3)

First blade member: rubber hardness of 70°, rubber having an impact resilience of 60 percent (manufactured by Hokushin Kogyo Co.), free length "a" of 9 mm, and thickness $t_1$ of 2 mm Second blade member: the second blade member, having free length "b" of 5.4 mm and thickness $t_2$ of 1.5, mm was employed.

Impact resilience was varied as described in Table 6.

First blade member contact angle: 20°

First blade member load (N/m): 20 N/m

Evaluation of Cleaning Properties

As shown in Table 6, the impact resilience of the second blade member was varied, and by employing a digital copier, Konica 7050 (comprising processes utilizing corona charging, laser beam exposure, reversal development, electrostatic transfer, claw separation, and first blade member) which basically has image forming processes in described in FIG. 1., was carried out for evaluation of toner which was not removed by the first blade member, blade curl, and blade noise, and the image unevenness of halftone photographic images was also evaluated. Evaluation conditions were the same as Example 1. Table 6 shows the evaluation results.

TABLE 6

| | | | | | | | |
|---|---|---|---|---|---|---|---|
| $H_1$ | 60 | 60 | 60 | 60 | 60 | 60 | 60 |
| $H_2$ | 21 | 26 | 34 | 43 | 51 | 60 | 68 |
| $H_2/H_1$ | 5/14 | 3/7 | 4/7 | 5/7 | 6/7 | 1 | 8/7 |
| Blade Curl | not formed | not formed | not formed | not formed | not formed | not formed | not formed |
| Non-removed Toner | A | A | A | A | A | A | A |

The similar experiment was conducted by modifying the first and second blades. The result is summarized in Table 6'.

First blade member: rubber hardness of 60°, rubber having an impact resilience of 60 percent (manufactured by Hokushin Kogyo Co.), free length "a" of 10 mm, and thickness $t_1$ of 1 mm Second blade member: rubber hardness of 88°, (manufactured by Hokushin Kogyo Co.), free length "b" of 1.0 mm, and thickness $t_2$ of 3.0 mm was employed

TABLE 6'

| | | | |
|---|---|---|---|
| $H_1$ | 60 | 60 | 60 |
| $H_2$ | 13 | 17 | 77 |
| $H_2/H_1$ | 3/14 | 2/7 | 9/7 |
| Blade Curl | not formed | not formed | formed after 25 minutes |
| Non-removed Toner | B | B | A |

As can clearly be seen from Table 6 and Table 6', when the impact resilience of the second blade member as well as the first blade member satisfies the conditions of Formula 4, that is $2/7<H_2/H_1\leqq 18/7$, neither blade curl nor non-removed toner resulted, and excellent cleaning properties were exhibited, and no image unevenness was formed. On the other hand, when either $2/7\geqq H_2/H_1$ or $H_2/H_1<8/7$ held true, either non-removed toner or blade curl resulted was also formed.

Example 5

Example Conditions 1 through 9

Photoreceptors, developers and cleaning conditions were combined as shown in Table 7.

Variation of combinations of the second blade member and the first blade members Configuration: combinations of materials, the free length, and the thickness of the first blade member as well as the second blade member were varied, and as a result, values of formulas 1 through 4 also varied.

First blade member contact angle: described in Table 7

First blade member load (N/m): described in Table 7

Evaluation of Cleaning Properties

As shown in Table 7, the combination of the photoreceptor, the toner, the first blade member and the second blade member was varied, and by employing a digital copier, Konica 7050 (comprising processes utilizing corona charging, laser beam exposure, reversal development, electrostatic transfer, claw separation, and first blade member) which basically had image forming processes in described in FIG. 1., was carried out for evaluation of the toner which was not removed by the first blade member, blade curl, and blade noise, and image unevenness of halftone photographic images was also evaluated. Evaluation conditions were the same as Example 1. Table 7 shows conditions of the example, and Table 7 shows the evaluation results.

TABLE 7

| | Example Conditions | | | | | | | |
|---|---|---|---|---|---|---|---|---|
| Example Condition No. | Photo-receptor No. | Toner No. | Blade Contact Angle (in degrees) | Blade Contact Load (in N/m) | Formula 1: b/a | Formula 2: $t_2/t_2$ | Formula 3: $K_2/K_1$ | Formula 4: $H_2/H_1$ |
| 1 | P1 | T1 | 15 | 20 | 0.7 | 0.4 | 1 | 1 |
| 2 | P2 | T2 | 20 | 30 | 0.7 | 0.6 | 8/7 | 8/7 |
| 3 | P3 | T3 | 25 | 10 | 0.7 | 0.8 | 6/7 | 3/7 |
| 4 | P1 | T2 | 25 | 30 | 0.5 | 0.4 | 6/7 | 1 |
| 5 | P2 | T3 | 15 | 10 | 0.5 | 0.6 | 8/7 | 8/7 |
| 6 | P3 | T1 | 20 | 20 | 0.5 | 0.8 | 1 | 3/7 |
| 7 | P1 | T3 | 20 | 20 | 0.1 | 2 | 10/7 | 2/7 |
| 8 | P2 | T1 | 15 | 10 | 0.1 | 1/30 | 5/7 | 9/7 |
| 9 | P3 | T2 | 25 | 30 | 0.9 | 2 | 5/7 | 9/7 |

TABLE 8

| Example Condition No. | Evaluation Item: Non-removed Toner | Blade Curl | Blade Noise (generation of abnormal noise) | Image Unevenness | Remarks |
|---|---|---|---|---|---|
| 1 | A | not formed | not generated | not formed | within the present invention |
| 2 | A | not formed | not generated | not formed | within the present invention |
| 3 | A | not formed | not generated | not formed | within the present invention |
| 4 | A | not formed | not generated | not formed | within the present invention |
| 5 | A | not formed | not generated | not formed | within the present invention |
| 6 | A | not formed | not generated | not formed | within the present invention |
| 7 | B | not formed | not generated | formed | out of the present invention |
| 8 | C | not formed | not generated | formed | out of the present invention |
| 9 | C | formed after 30 minutes | generated | formed | out of the present invention |

As can clearly be seen from Tables 7 and 8, for combinations of the second blade member and the first blade member, example conditions 1 through 6, which satisfied the conditions of Formulas 1 through 4, resulted in neither blade curl nor non-removed toner, and exhibited excellent cleaning properties. Further no image unevenness was formed. On the other hand, example conditions 7 through 9, which did not satisfy Formulas 1 through 4, resulted in at least either non-removed toner, blade curl, and blade noise, and image unevenness was also formed.

As can clearly be seen from the aforementioned examples, by employing a cleaning unit which comprises a first blade member which is adhered with a second blade member under the conditions of the present invention, it is possible to effectively remove the residual toner on the photoreceptor without resulting in blade curl and non-removed toner. Further, it is possible for the present invention to provide an image forming method as well as an image forming apparatus, employing said cleaning unit.

What is claimed is:

1. A cleaning unit for removing residual toner on a photoreceptor wherein the cleaning unit comprises a cleaning blade composed of a plurality of plate materials adhered to each other, the plurality of plate materials including a first blade member and a second blade member each of which is mounted on a support member, the first blade member being brought into contact with said photoreceptor and the second blade member not being brought into contact with said photoreceptor, wherein impact resilience $H_1$ of the first blade member and impact resilience $H_2$ of the second blade member satisfies condition of $0.1H_2<H_1$.

2. The cleaning unit of claim 1 wherein length $L_1$ of the first blade member is longer than length $L_2$ of the second blade member.

3. The cleaning unit of claim 1 wherein each of the plurality of plate materials is laminated with an adhesive layer.

4. The cleaning unit of claim 1, wherein the cleaning blade satisfies one of following conditions;

$$0.1<b/a\leqq 0.9$$

wherein a is a free length of the first blade member and b is a free length of the second blade member, $$1/30<t_2/t_1<2$$

wherein $t_1$ is a thickness of the first blade member and $t_2$ is a thickness of the second blade member, $$5/7<K_2/K_1<10/7$$

wherein $K_1$ is JIS A Hardness of the first blade member and $K_2$ is JIS A Hardness of the second blade member, and $$2/7<H_2/H_1\leqq 8/7$$

wherein $H_1$ is an impact resilience of the first blade member and $H_2$ is an impact resilience of the second blade member.

5. The cleaning apparatus of claim 4 wherein b/a is 0.3 to 0.8.

6. The cleaning apparatus of claim 5 wherein $t_2/t_1$ is 1/8 to 5/4, $K_2/K_1$ is 11/14 to 9/7, and $H_2/H_1$ is 3/7 to 8/7.

7. The cleaning apparatus of claim 4 wherein $t_2/t_1$ is 1/8 to 5/4.

8. The cleaning apparatus of claim 4 wherein $K_2/K_1$ is 11/14 to 9/7.

9. The cleaning apparatus of claim 4 wherein $H_2/H_1$ is 3/7 to 8/7.

10. The cleaning unit of claim 1 wherein the cleaning unit satisfies the all of the following conditions;

$$0.1<b/a\leqq 0.9$$

wherein a is free length of the first blade member and b is free length of the second blade member, $$1/30<t_2/t_1<2$$

wherein $t_1$ is thickness of the first blade member and $t_2$ is thickness of the second blade member, $$5/7<K_2/K_1<10/7$$

wherein $K_1$ is JIS A Hardness of the first blade member and $K_2$ is JIS A Hardness of the second blade member, and $$2/7<H_2/H_1<8/7.$$

11. A cleaning apparatus for removing residual toner on a photoreceptor wherein the cleaning apparatus comprises a cleaning blade composed of a plurality of plate materials adhered to each other, the plurality of plate materials including a first blade member and a second blade member each of which is mounted on a support member, the first blade member being brought into contact with said photoreceptor and the second blade member not being brought into contact with said photoreceptor, wherein length $L_1$ of the first blade member is longer than length $L_2$ of the second blade member, and the cleaning unit satisfies all of the following conditions:

$$0.1<b/a\leqq 0.9$$

wherein a is free length of the first blade member and b is free length of the second blade member, $$1/30<t_2/t_1<2$$

wherein $t_1$ is thickness of the first blade member and $t_2$ is thickness of the second blade member, $$5/7<K_2/K_1<10/7$$

wherein $K_1$ is JIS A Hardness of the first blade member and $K_2$ is JIS A Hardness of the second blade member, and $$2/7<H_2/H_1\leqq 8/7$$

wherein $H_1$ is impact resilience of the first blade member and $H_2$ is impact resilience of the second blade member.

12. The cleaning apparatus of claim 11 wherein each of the plurality of plate materials is laminated with an adhesive layer.

13. The cleaning apparatus of claim 11 wherein b/a is 0.3 to 0.8.

14. The cleaning apparatus of claim 13 wherein the second blade member is elastic material.

15. The cleaning apparatus of claim 11 wherein $t_2/t_1$ is 1/8 to 5/4.

16. The cleaning apparatus of claim 15 wherein b/a is 0.3 to 0.8.

17. The cleaning apparatus of claim 16 wherein $t_2/t_1$ is 1/8 to 5/4.

18. The cleaning apparatus of claim 17 wherein $K_2/K_1$ is 11/14 to 9/7.

19. The cleaning apparatus of claim 16 wherein $H_2/H_1$ is 3/7 to 8/7.

20. The cleaning apparatus of claim 11 wherein $K_2/K_1$ is 11/14 to 9/7.

21. The cleaning apparatus of claim 11 wherein $H_2/H_1$ is 3/7 to 8/7.

22. The cleaning apparatus of claim 11 wherein b/a is 0.3 to 0.8, $t_2/t_1$, is 1/8 to 5/4, $K_2/K_1$ is 11/14 to 9/7, and $H_2/H_1$ is 3/7 to 8/7.

23. A cleaning apparatus removing residual toner on a photoreceptor wherein the cleaning apparatus comprises a cleaning blade composed of a plurality of plate materials adhered to each other, the plurality of plate materials including a first blade member and a second blade member each of which is mounted on a support member, the first blade member being brought into contact with said photoreceptor and the second blade member not being brought into contact with said photoreceptor, wherein the cleaning unit satisfies all of the following conditions;

$$0.1<b/a\leqq 0.9$$

wherein a is free length of the first blade member and b is free length of the second blade member $$1/30<t_2/t_1<2$$

wherein $t_1$ is thickness of the first blade member and $t_2$ is thickness of the second blade member, $$5/7K_2/K_1<10/7$$

wherein $K_1$ is JIS A Hardness of the first blade member and $K_2$ is JIS A Hardness of the second blade member, and $$2/7<H_2/H_1<8/7$$

wherein $H_1$ is impact resilience of the first blade member and $H_2$ is impact resilience of the second blade member.

24. The cleaning apparatus of claim 23 wherein b/a is 0.3 to 0.8.

25. The cleaning apparatus of claim 23 wherein $t_2/t_1$ is 1/8 to 5/4.

26. The cleaning apparatus of claim 23 wherein $K_2/K_1$ is 11/14 to 9/7.

27. The cleaning apparatus of claim 26 wherein $H_2/H_1$ is 3/7 to 8/7.

28. The cleaning apparatus of claim 23 wherein $t_2/t_1$ is 1/8 to 5/4.

29. The cleaning apparatus of claim 28 wherein length $L_1$ of the first blade member is longer than length $L_2$ of the second blade member.

30. The cleaning apparatus of claim 23 wherein $K_2/K_1$, is 11/14 to 9/7.

31. The cleaning apparatus of claim 23 wherein $H_2/H_1$ is 3/7 to 8/7.

32. The cleaning apparatus of claim 23 wherein the second blade member is elastic material.

33. The cleaning apparatus of claim 23 wherein each of the plurality of plate materials is laminated with an adhesive layer.

34. The cleaning apparatus of claim 23 wherein $t_2/t_1$ is 1/8 to 5/4, $K_2/K_1$ is 11/14 to 9/7, and $H_2/H_1$ is 3/7 to 8/7.

35. The cleaning apparatus of claim 23 wherein length $L_1$ of the first blade member is longer than length $L_2$ of the second blade member.

36. A cleaning apparatus comprising a cleaning blade composed of a first blade member and a second blade member each of which is mounted on a support member, the first blade member being brought into contact with a photoreceptor and the second blade member not being brought into contact with the photoreceptor, wherein the cleaning blade satisfies all of following conditions;

$$1/30<t_2/t_1<2$$

wherein $t_1$ is thickness of a first blade member and $t_2$ is thickness of a second blade member, $b/a$ is 0.3 to 0.8, wherein a is free length of a first blade member and b is free length of a second blade member, $$5/7<K_2/K_1<10/7$$

wherein $K_1$ is JIS A Hardness of the first blade member and $K_2$ is JIS A Hardness of the second blade member, and $$2/7<H_2/H_1<8/7$$

wherein $H_1$ is impact resilience of the first blade member and $H_2$ is impact resilience of the second blade member.

37. The cleaning apparatus of claim 36 wherein $t_2/t_1$ is 1/8 to 5/4.

38. The cleaning apparatus of claim 36 wherein $K_2/K_1$ is 11/14 to 9/7.

39. The cleaning apparatus of claim 36 wherein $H_2/H_1$ is 3/7 to 8/7.

40. The cleaning apparatus of claim 36 wherein $K_2/K_1$ is 11/14 to 9/7.

41. The cleaning apparatus of claim 36 wherein $H_2/H_1$ is 3/7 to 8/7.

42. The cleaning apparatus of claim 36 wherein $K_2/K_1$ is 11/14 to 9/7 and $H_2/H_1$ is 3/7 to 8/7.

43. The cleaning apparatus of claim 36 wherein length $L_1$ of the first blade member is longer than length $L_2$ of the second blade member.

44. The cleaning apparatus of claim 36 wherein the second blade member is elastic material.

45. A cleaning apparatus comprising a cleaning blade composed of a first blade member and a second blade member each of which is mounted on a support member, the first blade member being brought into contact with a photoreceptor and the second blade member not being brought into contact with the photoreceptor, wherein the cleaning blade satisfies all of following conditions;

$$0.1<b/a\leqq 0.9$$

wherein a is free length of a first blade member and b is free length of a second blade member, $$1/30<t_2/t_1<2$$

wherein $t_1$ is thickness of the first blade member and $t_2$ is thickness of the second blade member, $$5/7<K_2/K_1<10/7$$

wherein $K_1$ is JIS A Hardness of the first blade member and $K_2$ is JIS A Hardness of the second blade member, and $$2/7<H_2/H_1\leqq 8/7$$

wherein $H_1$ is impact resilience of a first blade member and $H_2$ is impact resilience of a second blade member.

46. The cleaning apparatus of claim 45 wherein each of the plurality of plate materials is laminated with an adhesive layer.

47. The cleaning apparatus of claim 45 wherein $K_2/K_1$ is 11/14 to 9/7.

48. The cleaning apparatus of claim 45 wherein $H_2/H_1$ is 3/7 to 8/7.

49. The cleaning apparatus of claim 45 wherein the second blade member is elastic material.

50. An image forming method comprising steps of exposing a photoreceptor uniformly, imagewise exposing to form a latent image, developing the latent image by toner to form a toner image, transferring the toner image to a recording material, fixing transferred toner image and cleaning a residual toner on the photoreceptor by a cleaning unit, wherein the cleaning unit comprises a cleaning blade composed of a plurality of plate materials adhered to each other, the plurality of plate material including a first blade member and a second blade member each of which is mounted on a support member, the first blade member being brought into contact with said photoreceptor and the second blade member not being brought into contact with said photoreceptor, and the cleaning blade satisfies all of following conditions;

$$0.1<b/a\leqq 0.9$$

wherein a is free length of a first blade member and b is free length of a second blade member, $$1/30<t_2/t_1<2$$

wherein $t_1$ is thickness of the first blade member and $t_2$ is thickness of the second blade member, $$5/7<K_2/K_1<10/7$$

wherein $K_1$ is JIS A Hardness of a first blade member and $K_2$ is JIS A Hardness of a second blade member, $$2/7<H_2/H_1<8/7, \text{ and}$$

$$0.1H_2<H_1$$

wherein $H_1$ is impact resilience of a first blade member and $H_2$ is impact resilience of a second blade member.

51. An image forming method of claim 50 wherein toner has a variation coefficient of a shape coefficient of toner particles of not more than 16 percent, and a number variation coefficient of a number size distribution of said toner particles of not more than 27 percent.

52. An image forming apparatus comprising a photoreceptor, and an exposing unit to form a latent image on the photoreceptor, a developing unit to visualize toner image, a transferring unit to transfer visualized toner image to a recording material, a fixing unit to fix the toner image transferred on the recording material and a cleaning unit to clean a residual toner on the photoreceptor, wherein the cleaning unit comprises a cleaning blade composed of a plurality of plate materials adhered to each other, the plurality of plate material including a first blade member and a second blade member each of which is mounted on a support member, the first blade member being brought into contact with said photoreceptor and the second blade member not being brought into contact with said photoreceptor, and the cleaning blade satisfies all of following conditions;

$$0.1<b/a\leqq 0.9$$

wherein a is free length of a first blade member and b is free length of a second blade member, $$1/30<t_2/t_1<2$$

wherein $t_1$ is thickness of the first blade member and $t_2$ is thickness of the second blade member, $$5/7<K_2/K_1<10/7$$

wherein $K_1$ is JIS A Hardness of a first blade member and $K_2$ is JIS A Hardness of a second blade member, $$2/7<H_2/H_1\leqq 8/7, \text{ and}$$

$$0.1H_2<H_1$$

wherein $H_1$ is impact resilience of a first blade member and $H_2$ is impact resilience of a second blade member.

53. The image forming apparatus of claim 52 wherein contact angle θ of the first blade member against the photoreceptor is not less than 10 degrees.

* * * * *